US011162747B2

(12) United States Patent
Walsh et al.

(10) Patent No.: US 11,162,747 B2
(45) Date of Patent: Nov. 2, 2021

(54) WATER-TREATMENT, DESCALING, AND MONITORING SYSTEM

(71) Applicants: Joseph F. Walsh, Sequim, WA (US); Sharon K. Laska, Sequim, WA (US)

(72) Inventors: Joseph F. Walsh, Sequim, WA (US); Sharon K. Laska, Sequim, WA (US)

( * ) Notice: Subject to any disclaimer, the term of this patent is extended or adjusted under 35 U.S.C. 154(b) by 0 days.

(21) Appl. No.: 16/712,004

(22) Filed: Dec. 12, 2019

(65) Prior Publication Data

US 2020/0116445 A1 Apr. 16, 2020

Related U.S. Application Data

(63) Continuation-in-part of application No. 15/456,514, filed on Mar. 11, 2017, now Pat. No. 10,823,516.

(60) Provisional application No. 62/308,028, filed on Mar. 14, 2016.

(51) Int. Cl.
*F28G 13/00* (2006.01)

(52) U.S. Cl.
CPC ..... *F28G 13/00* (2013.01)

(58) Field of Classification Search
CPC ..... F28G 13/00
See application file for complete search history.

(56) References Cited

U.S. PATENT DOCUMENTS 9,347,684 B2 * 5/2016 Wielstra ..... F22B 1/30
2005/0161379 A1 * 7/2005 Tsuboi ..... C23G 5/00 210/138
2005/0274602 A1 * 12/2005 Herrington ..... C02F 1/4602 204/196.01
2014/0202542 A1 * 7/2014 LaRocque ..... C02F 1/04 137/1
2015/0090593 A1 * 4/2015 Fayle ..... C02F 1/4602 204/555

* cited by examiner

*Primary Examiner* — Akm Zakaria
(74) *Attorney, Agent, or Firm* — Olympic Patent Works PLLC

(57) ABSTRACT

The present document discloses water-treatment, descaling, and monitoring systems that include components selected from among: (1) water-treatment components; (2) a component that protects system components, plumbing, and appliances from limescale build-up by generation of a pure sine-wave descaling signal that passes FCC requirements; (3) a component that generates an electrolysis-inhibiting signal; (4) components that monitor propagation and the strength of the descaling signal within the plumbing system; (5) probe and sensor components that monitor water quality, the operational status of other components, and system characteristics; (6) components that prevent the descaling signal from interfering with probes, sensors, and water-treatment-system components; (7) a component that generates UV radiation for eliminating biological contaminants within water heaters and other appliances; and (8) wireless-communications components that facilitate transmission of alerts regarding operational status and water quality, remote control of system components in response to alerts, receiving system firmware and parameter updates, and transmitting status and monitoring data.

2 Claims, 15 Drawing Sheets

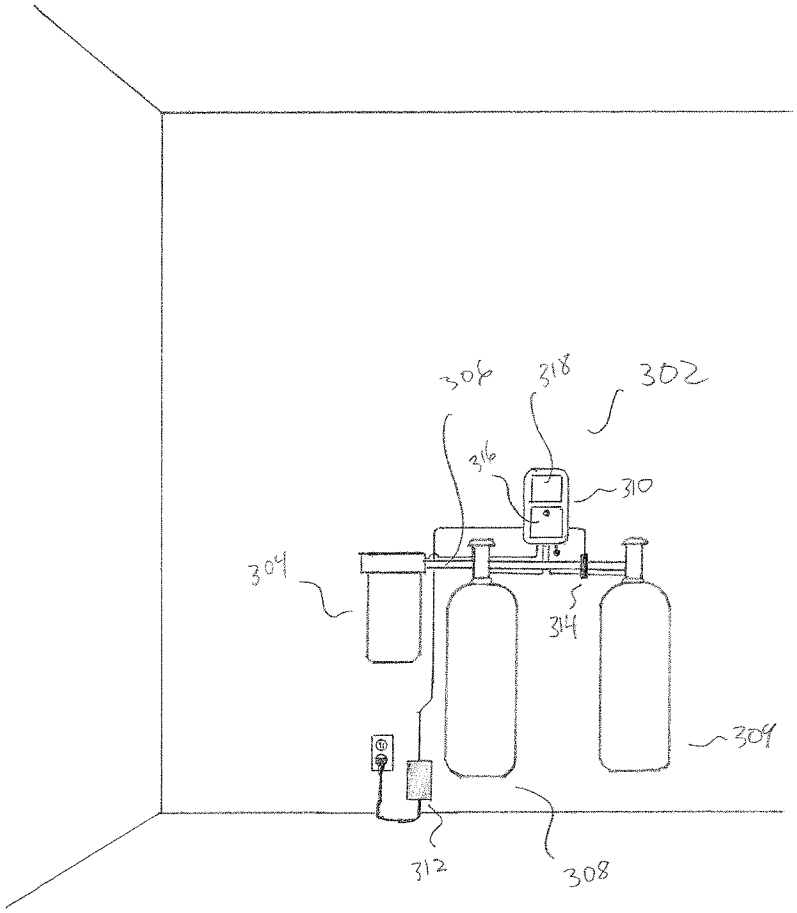

Figure 3

Water Treatment and Monitoring System

- reduces/removes
  - pesticides
  - water-treatment chemicals and by-products
  - metal ions
  - bacteria, protozoans, and parasites
  - odors
- monitors
  - water quality
  - water pressure
  - Filters
  - measurement probes
  - UV sources
  - AC ground
  - descaling signal strength
  - water volume
  - water-flow rate
- descales
  - plumbing
  - appliances
  - measurement probes
  - UV sources
- inhibits electrolysis
- generates local and remote alerts
- detects
  - non-functional AC-ground
  - shorted descaler detection points
  - descaler-signal transfer to water
- adjusts and adapts
  - Filters
  - water pressure
- provides access by remote communications
- provides communications
  - downloads of firmware/parameters
  - upload of monitoring data

WATER-TREATMENT, DESCALING, AND MONITORING SYSTEM

CROSS-REFERENCE TO RELATED APPLICATIONS

This application is a continuation-in-part of application Ser. No. 15/456,514, filed Mar. 11, 2017, which claims the benefit of Provisional Application No. 62/308,028.

TECHNICAL FIELD

The present document is directed to commercial and residential water-treatment, descaling, and monitoring systems and, in particular, to water-treatment, descaling, and monitoring systems that include one or more descalers, treated-water-quality and component-operation monitors, UV sources for reducing or eliminating biological contaminants, various types of water filters and electronically-adjustable water filters for removing undesirable chemical species, electrolysis-inhibiting-signal generators, alert generators, communications interfaces to remote computational entities, interfaces to controllable electromechanical devices, and processor executed programs and routines that provide flexible, easily updateable, and powerful control functionality.

BACKGROUND

As one of the fundamental requirements for life, water has played a central role in human civilization from pre-historical times to the present. Access to water is one of the most basic and primary requirements for individual humans as well as for villages, towns, and cities, and has served as the motivation for development of water-provision and water-treatment technologies, facilities, and services over the course of the past 7000 years. Human settlements generally arose near surface-water sources, including rivers, lakes, and natural springs. Increasingly complex water-delivery, water-treatment, and water-borne-waste-treatment technologies and facilities were developed in tandem with population growth and development of ever-increasing percentages of the world's landmass for agriculture and habitation. With large increases in urban populations, community and regional water utilities, generally managed through local and regional governments, were developed to provide clean water to the inhabitants of cities and other populated areas, along with community and regional sewage systems and governmental oversight agencies and departments. Development of sand filters, water chlorination, and other technologies led to great improvements in public health and made possible the densely populated urban areas of the modern world.

Unfortunately, community and regional water utilities have begun to fall short of the ability to provide clean water to their customers, for a variety of reasons. Modern technology has produced, in addition to improved water-delivery and water-treatment methods and systems, many new types of toxic chemicals, including pesticides, synthetic manufacturing-process solvents, lubricants, degreasers, disinfectants, special-purpose chemical agents, pharmaceuticals, and manufacturing-process by-products that increasingly find their way into water sources, as well as undesirable concentrations of many types of metal ions and other naturally occurring, but toxic chemical species. Many of these toxic chemical species are not effectively removed by traditional water-treatment methods. In addition, as once new and effective water-delivery infrastructure ages and deteriorates, the water-delivery system, itself, has become a source of various types of toxic contaminants, including lead and other metal ions and biological contaminants, which enter the public water supply downstream from the traditional water-treatment systems, such as sand filters. As a result, over time, it is expected that the burden for final water treatment will increasingly fall on owners, managers, and residents of residential properties and on individual and corporate owners of commercial properties. Already, many residences and commercial properties have deployed water-treatment systems to carry out final treatment of water received from public water utilities in order to guarantee clean and safe water within residential and commercial buildings. However, many water-treatment problems have not been adequately addressed by present water-treatment systems, including buildup of limescale within pipes and appliances due to hard water, failure to adaptively respond to changing types and levels of contaminants in water received from the public water supply or wells, and failure to monitor the quality of the water produced by the water-treatment systems, over time, in order to detect unforeseen problems, filter-capacity exhaustion, and water-treatment-system-component failures. Designers, vendors, and users of residential and commercial water-treatment systems continue to seek improvements in water-treatment systems and technologies in order to guarantee clean and safe water within residential buildings, commercial buildings, and various types of venues and facilities.

SUMMARY

The present document discloses various different types of water-treatment, descaling, and monitoring systems and components that address deficiencies in presently available water-treatment systems. Certain of the presently disclosed water-treatment systems include electronic descalers along with logic and circuitry to guarantee that the descaling signal is present at adequate strength within plumbing and appliances to remediate and prevent deposition of limescale within the plumbing and appliances as well as logic and circuitry to prevent descaling signals generated by electronic descalers from interfering with various types of probes, sensors, and other components of the water-treatment, descaling, and monitoring systems. The present descaler also prevents lime scale build-up from inhibiting the performance of probes, sensors, and other components of the water-treatment, descaling, and monitoring systems. Certain of the presently disclosed water-treatment, descaling, and monitoring systems include various types of probes and sensors that monitor one or more of the qualities of the treated water produced by the water-treatment, descaling, and monitoring systems as well as remaining filter capacities, functional characteristics of various components, including UV sources, water pressure, and descaling-signal strength. Certain of the presently disclosed water-treatment, descaling, and monitoring systems generate electrolysis-inhibiting currents or voltages, descaling signals, and/or UV radiation for eliminating biological contaminants within water heaters and other appliances. Certain of the presently disclosed water-treatment, descaling, and monitoring systems can be automatically and/or remotely controlled to adjust filters, water pressure, and other system components and characteristics in order to respond to changing conditions. Certain of the presently disclosed water-treatment, descaling, and monitoring systems provide various types of communications facilities for communicating with remote computational entities in order to download firmware and parameter updates from external sources, upload monitoring data and other data to external computational entities, to provide remote access to various components of the water-treatment, descaling, and monitoring system, and to provide direct access to the water-treatment, descaling, and monitoring system by remote control of components and systems accessible by the water-treatment, descaling, and monitoring system, such as garage-door openers for permitting access to the water-treatment, descaling, and monitoring system by service personnel.

BRIEF DESCRIPTION OF THE DRAWINGS

FIG. 3 illustrates a residential water-treatment, descaling, and monitoring system that incorporates the presently disclosed methods and system components and that represents an implementation of the presently disclosed water-treatment, descaling, and monitoring systems.

DETAILED DESCRIPTION

Figure 1:
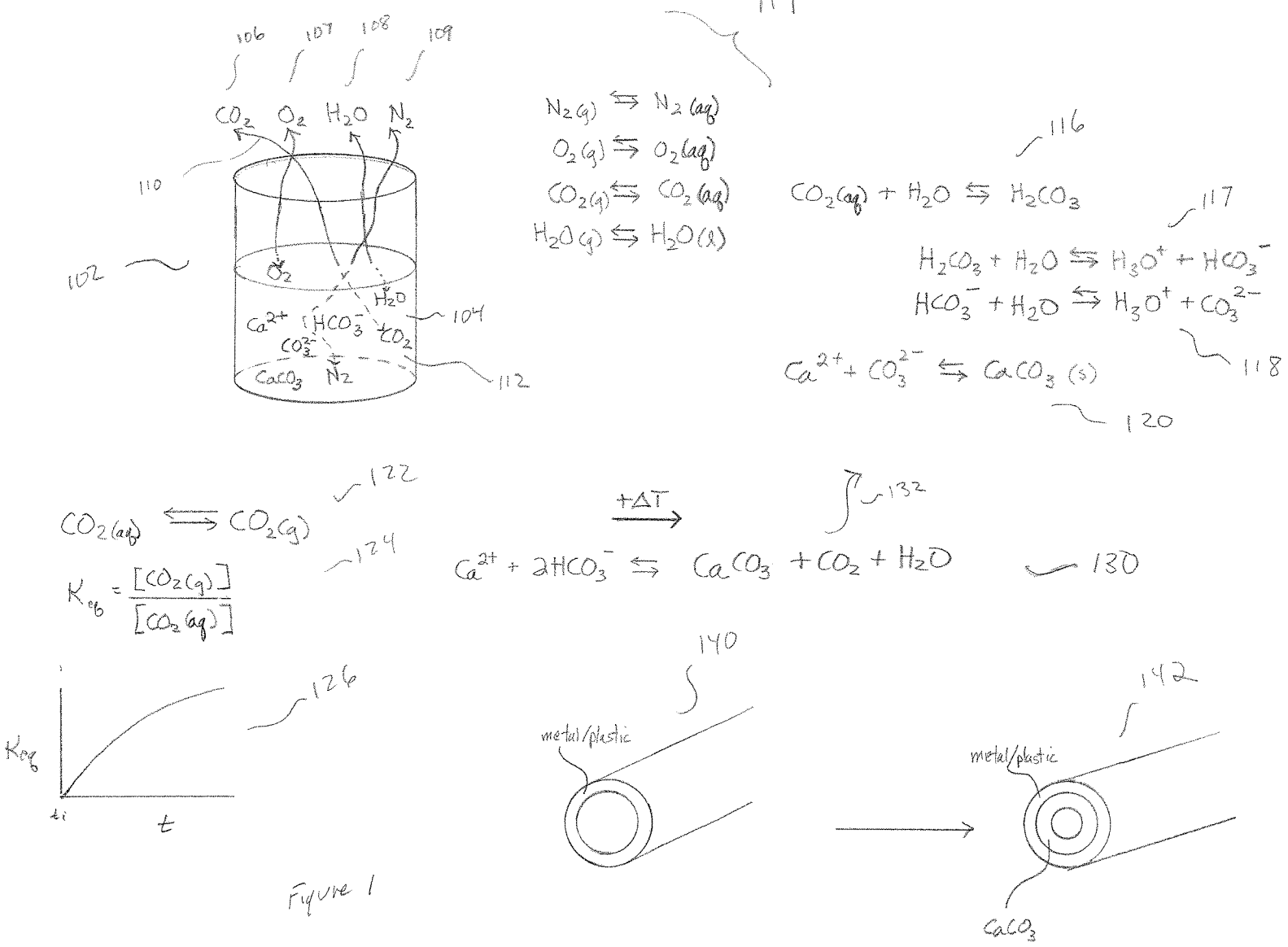
FIG. 1 illustrates limescale deposition within plumbing and appliances.

FIG. 1 illustrates limescale deposition within plumbing and appliances. A reservoir partly filled with water 102 is shown in the upper left portion of FIG. 1. As indicated diagrammatically in FIG. 1, the chemical state of the water 104 in contact with the atmosphere is complex. Only a portion of the complexity is illustrated in, and discussed with reference to, FIG. 1. Small amounts of gaseous carbon dioxide 106, oxygen 107, water vapor 108, and nitrogen 109 in the atmosphere dissolve in the water, as indicated by the double-headed, curved arrows, such as arrow 110 between the symbols for atmospheric carbon dioxide 106 and dissolved carbon dioxide 112. In fact, there is a constant exchange of carbon-dioxide, oxygen, water-vapor, and nitrogen molecules between the atmosphere and the water, as represented by the four equations 114. Dissolved carbon dioxide reacts with water to form carbonic acid, $H_2CO_3$, as indicated by equation 116. Carbonic acid dissociates to form the bicarbonate ion $HCO_3^-$, as indicated by expression 117. The bicarbonate ion further dissociates, in water, to form carbonate ion $CO_3^{2-}$, as indicated by expression 118. Thus, water 104 in contact with the atmosphere not only contains dissolved carbon dioxide, oxygen, nitrogen, but also contains carbonic acid, bicarbonate ions, and carbonate ions, with the equilibrium concentrations computable from the equilibrium constants for the carbonic-acid-generation reaction 116 and the dissociation reactions 117-118, which, in turn, depend on the temperature and pressure.

Of course, water contains many other types of ions, chemical species, and substances, including various metal and metal-containing ions, such as calcium $Ca^{2+}$, magnesium $Mg^{2+}$, manganese(II) $Mn^{2+}$, lead $Pb^{2+}$, arsenate $H_2AsO_4^-$, copper $Cu^{2+}$, barium $Ba^{2+}$, sodium $Na^+$, cadmium $Cd^{2+}$, and potassium $K^+$ ions, chloride $Cl^-$, nitrate $NO_3^-$, and sulfate $SO_4^{2-}$ ions, and many other types of ions. In addition, water may contain asbestos, bacteria, protozoans, parasites, hydrogen sulfide, various iron ions, radon, insecticides, pharmaceuticals, viruses, organic debris, chlorination disinfection by-products, including monochloramine, a wide variety of different small-molecule organic compounds, plastic microparticles, and many other chemical species and substances. Different water supplies contain different types and concentrations of these various ions, chemical species, substances, and organisms. For example, in about 85% of the United States, water furnished by water utilities is considered to be hard, and has significantly greater concentrations of calcium and magnesium ions than in areas with soft water.

Calcium ions combine with carbonate ions to produce calcium carbonate $CaCO_3$, as indicated by equation 120. Calcium carbonate is the principal component of limescale, although limescale can contain small amounts of additional minerals. The generation of solid calcium-carbonate deposits is largely controlled by temperature. As indicated by expressions 122 and 124, the equilibrium concentrations of dissolved carbon dioxide and gaseous carbon dioxide is expressed as an equilibrium constant $K_{eq}$. The temperature dependency of the equilibrium constant is indicated by plot 126. The higher the temperature, the less dissolved carbon dioxide in water in contact with the atmosphere. Combining expressions 116-118 and 120 produces expression 130, which indicates that there is an equilibrium, in water exposed to the atmosphere, between calcium ions and bicarbonate ions, on the left side of the expression 130, and solid calcium carbonate, carbon dioxide, and water, on the right side of expression 130. As the temperature increases, in view of the equilibrium-constant temperature dependency shown in plot 126, dissolved carbon dioxide returns to the atmosphere, as indicated by arrow 132. This, in turn, shifts the equilibrium illustrated in expression 132 to the right, producing more calcium carbonate. Once the amount of calcium carbonate produced exceeds the saturation point, a solid calcium carbonate precipitates from solution and forms solid deposits on surfaces in contact with the solution. Thus, over time, the interior walls of a plastic or metal pipe 140, as one example, become coated with an ever thicker layer of limescale 142, which is mostly solid calcium carbonate.

Figure 2:
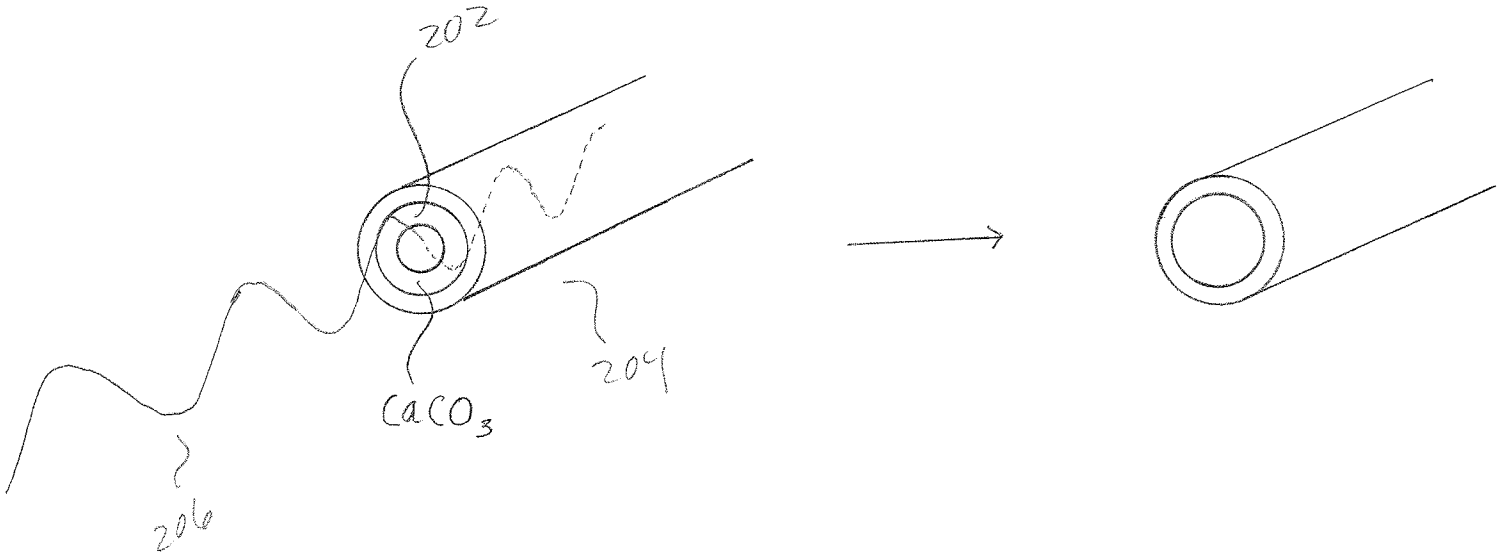
FIG. 2 illustrates removal of deposited limescale from the interior of a plumbing pipe by passing a descaling signal 206 through the water contained in the plumbing pipe.

Limescale deposits have many detrimental effects. Limescale deposits may significantly decrease the rate of flow of water through plumbing pipes, or even plug them altogether, and can serve as a convenient anchor for biofilms which, in turn, may host pathogenic microorganisms. Limescale deposits can significantly or severely reduce the operational effectiveness of components of appliances, such as heating elements in hot-water tanks and dishwashers, various types of monitoring probes, and the lenses or transparent tubes of UV sources used to reduce or eliminate biological contamination in water. As further discussed below, electronic descalers, when properly installed and configured, generate a descaling signal that is conducted through the water within pipes and appliances and that re-dissolves solid calcium carbonate, so that re-dissolved and detached calcium carbonate deposits are flushed from plumbing and appliances. The descaling signal also prevents formation of limescale deposits. FIG. 2 illustrates, using the limescale-free and limescale-fouled pipes 140 and 142 shown in FIG. 1, removal of deposited limescale 202 from the interior of a plumbing pipe 204, over time, by passing a descaling signal 206 through the water contained in the plumbing pipe.

Descalers are only one component of a comprehensive water-treatment, descaling, and monitoring system. As further discussed below, additional components may include a variety of different types of filters that filter undesirable metal ions, small-molecule contaminants, including pesticides and pharmaceuticals, larger aggregates of precipitated substances, and many other types of contaminants from water input from a public water utility or other sources. In addition to filters, UV sources can be used to kill various types of microorganisms. The UV radiation, of course, is fully contained within plumbing and appliances, and prevents no hazard to building occupants or to anyone else.

FIG. 3 illustrates a residential water-treatment, descaling, and monitoring system that incorporates the presently disclosed methods and systems and that represents an implementation of the presently disclosed water-treatment, descaling, and monitoring system. The water-treatment, descaling, and monitoring system 302 is often installed within a garage or utility room. Water input to the residence from the water utility or a well flows into a first pre-filter 304 and then through horizontal pipe 306 to a series of one or more additional water-treatment filters 308-309. The water then flows into the residential plumbing system, branching to the water heater and cold-water inputs to faucets, showerheads, toilets, and appliances. A control unit 310 is connected to a power supply 312. The control unit is discussed, in detail, below. In many implementations, the control unit includes a descaler which outputs a descaling signal to a magnetic coupling or hard wiring 314 which introduces the descaling signal into the water within horizontal pipe 306. The descaling signal can be introduced at various different points of the plumbing system, provided that the connection point is not grounded, as further discussed below. The control unit includes various types of interfaces within a compartment 316 as well as a liquid-crystal display ("LCD") of a front-panel display 318 or another type of front-panel display.

In a right-hand text column 320 in FIG. 3, various functions and features of the presently disclosed water-treatment, descaling, and monitoring system are listed, to summarize these functions and features, which are discussed, in greater detail, below. Not all implementations of the presently disclosed water-treatment, descaling, and monitoring system include all of these functions and features, but even subsets of the listed functions and features provided significant advantages over present water-treatment systems and addresses various of the types of problems, discussed above, and additional problems and considerations discussed below. Implementations of the presently disclosed water treatment-and-monitoring systems can reduce or remove pesticides, water-treatment chemicals and by-products, undesirable metal ions, bacteria, protozoans, and parasites, and many other types of ions, other chemical species, and substances from water input to the water-treatment, descaling, and monitoring system from a well, surface source, or from a water utility. Implementations of the presently disclosed water treatment-and-monitoring systems monitor, using various probes and sensors, one or more of the treated water quality, water pressure within the plumbing, the remaining filter capacities of various types of filters used for water treatment, the operational condition of the probes and sensors, the operational condition of UV sources, the descaling-signal strength in the water within the plumbing, whether or not the plumbing has been shorted to ground, and whether or not the AC ground within the building is correctly configured. The descaler included in implementations of the presently disclosed water treatment-and-monitoring systems effectively descales and prevents scale formation on internal surfaces of the plumbing, appliances, monitoring probes and sensors, and UV sources. Implementations of the presently disclosed water treatment-and-monitoring systems can generate DC signals to inhibit electrolysis within water heaters and other appliances. Implementations of the presently disclosed water treatment-and-monitoring systems can generate alerts both through the front-panel display as well as to remote service providers so that any deteriorating or non-functional components of the water treatment-and-monitoring systems can be quickly detected and serviced or replaced. Implementations of the presently disclosed water treatment-and-monitoring systems can adjust and adapt certain controllable filters, discussed below, in view of present contaminant types and concentrations, and can transmit control signals to well pumps in order to maintain desired water pressures. Implementations of the presently disclosed water treatment-and-monitoring systems can be remotely accessed, by owners or residents of a building, to open a garage door or other entrance for service personnel to inspect and service the water treatment-and-monitoring systems. Finally, implementations of the presently disclosed water treatment-and-monitoring systems provide various types of interfaces to allow service-professionals to access memory and control-unit functions as well as various types of communications interfaces that provide for secure transmission of information from the control unit to service providers, water utilities, and other external entities, reception of firmware and parameter-valued downloads from service providers and vendors, and secure communications with other external entities.

Figure 4:
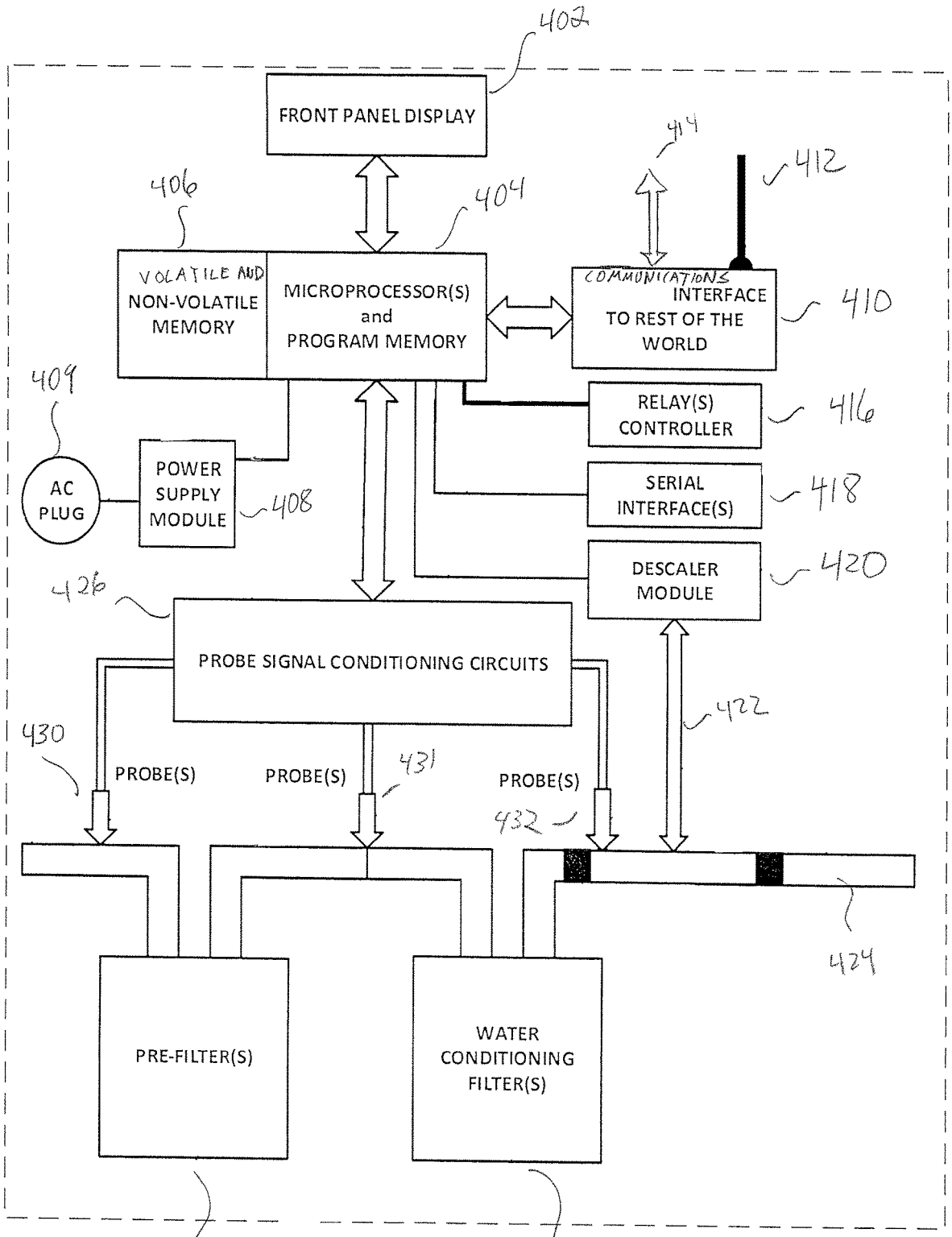
FIG. 4 illustrates one implementation of the presently disclosed water-treatment, descaling, and monitoring system.

FIG. 4 illustrates one implementation of the presently disclosed water-treatment, descaling, and monitoring system. The various components of the water-treatment, descaling, and monitoring system 400 shown in FIG. 4 include components within the control unit (310 in FIG. 3) as well as components external to the control unit. The front-panel display 402 is, in the implementation shown in FIG. 3, mounted to an exposed surface of the control unit 310. In alternative implementations, the front-panel display may be distinct from the control unit or may be alternatively mounted to, or incorporated within, the control unit. The front-panel display may be any of various different types of optical-display units, from a series of processor-controlled light sources, for lower-end front-panel-display implementations, to liquid-crystal displays, LEDs, and other such graphical displays, for higher-end front-panel-display implementations. In certain implementations, the front-panel display may have touch-screen capabilities for user input. In other implementations, the front-panel display may be accompanied with various types of input features, including electromechanical buttons or keys and even microphones connected to voice-recognition modules, and additional output features, such as audio speakers or independently illuminated elements, such as flashing warning LED optical elements and relays. The front-panel display provides status information for the water-treatment, descaling, and monitoring system, may display various types of alerts and warnings, and may provide for various types of user input, including setting numerical values for various operational parameters, invoking various types of functionalities provided by the control unit, and querying the control unit for status information, and may provide a communications interface that allows users to view messages generated by the control unit or sent by remote entities to the control unit and to compose and send messages to remote entities, such as service providers and utilities.

One or more microprocessors 404 and one or more memory devices 406 together provide for execution of routines and programs that implement the control logic for the water-treatment, descaling, and monitoring system. The memory devices include, in one implementation, both volatile and non-volatile memory, with the non-volatile memory used for storing a boot routine, control parameters, and control routines while the volatile memory is used for temporarily storing computed values generated during execution of routines and programs and for implementing various types of buffers used during communications and interactions with additional processor-controlled devices and peripherals.

A power-supply module 408 provides power to components of the water-treatment, descaling, and monitoring system, including to the microprocessor or microprocessors 404, the memory devices 406, front-panel display, and other components. The power-supply module, which receives power input from an AC outlet 409 in one implementation, may be separately housed from the control unit, as shown in FIG. 3, or may be incorporated within the control unit, in alternative implementations. In certain jurisdictions, external power-supply modules are desired, since they must be checked and verified following installation of the water-treatment, descaling, and monitoring system.

A communications interface 410 provides communications between the control unit and remote computational entities. A given implementation may support one or more different types of communications interfaces and communications media. For example, one class of communications interfaces and communications media is wireless communications through radio-frequency electromagnetic signals, via antenna 412, and another class of communications interfaces may include connections to local-area networks 414, such as Ethernet networks, for transmission and reception of TCP/IP messages. Wireless-communications interfaces may include: (1) Wi-Fi (IEEE 802.11) communications devices that communicate by radio-frequency electromagnetic signals with a Wi-Fi router which, in turn, provides access to the Internet through the public switched telephone network ("PSTN"), the cellular network, or through local-area networks; (2) Blue Tooth (IEEE 802.15.1) and other similar radio-frequency communications devices that provide access to the cellular network, PSTN, and Internet via smart phones; and (3) Internet-of-things ("ioT") communications that provides low-cost access to the cellular network and Internet. These are all examples of the many different possible communications technologies that can be used to interconnect the control unit with remote entities. In all cases, various types of communications protocols allow for secure communications between the control unit and remote entities through one or more of many different secure-communications technologies. In general, these technologies employ various types of encryption/decryption to avoid readable text from being transmitted through communications media that would allow malicious entities to intercept and read the text as well as authentication and authorization. Secure communications is supported by a variety of different commercially available and open-source secure-communications implementations. These technologies, along with a secure-boot loader, for example, provide for securely downloading firmware for execution by the control unit to prevent hacking of the control-unit firmware by malicious entities.

The few components of the water-treatment, descaling, and monitoring system already described with reference to FIG. 4, above, provide a basis for significant improvements to existing water-treatment systems. One problem with many existing water-treatment systems is that there is no automated monitoring of treated-water quality or monitoring of proper functioning of internal components. Even were there monitoring of water quality and proper functioning of internal components, many existing water-treatment systems lack any mechanisms or features for communicating detected problems to residents and owners of buildings in which they are installed, to remote service personnel, and to water utilities and other such organizations. By contrast, the presently disclosed water-treatment, descaling, and monitoring system, by including one or more microprocessors, a front-panel display, and communications interfaces, allow for robust and accurate monitoring of water quality and proper functioning of internal components as well as the means for communicating detected problems to residents and owners as well as to remote individuals and organizations. The front-panel display can display automatically generated alerts and status information in order to quickly inform residents and owners of problems and areas of concern. The control unit can contact remote entities, via the communications interface or interfaces, in order to inform service personnel of failed or failing components, filters approaching below-threshold capacities for continued effective filtering, failed plumbing, and other such problems and can inform water utilities and other organizations of detected water-quality and water-contamination issues that may be affecting additional water users drawing water from the same or geographically proximal sources. Monitoring routines executed by the one or more microprocessors are able to process and draw accurate conclusions from various different sensor and probe signals monitored by the firmware-implemented control logic of the presently disclosed water-treatment, descaling, and monitoring systems. Moreover, by keeping track of monitoring information, over time, the control logic can discern various types of patterns and indications of abnormalities based on departures from those patterns, thus allowing for inferences based on local conditions rather than on fixed, vendor-supplied parameters and thresholds. Firmware-based and software-based control logic provides a great deal of flexibility with respect to the different types of sensors and probes that may be incorporated into, or added to, a water-treatment, descaling, and monitoring system. For example, when new types of sensors or probes become available, firmware routines can be downloaded to incorporate them into the monitoring logic of the water-treatment, descaling, and monitoring system. These downloads are, of course, greatly facilitated by the wireless and network communications interfaces. Moreover, the types of analysis that can be undertaken by the control unit are far more complex and sophisticated than can be achieved by simple threshold-based and state-machine-based logic circuits. Service of the water-treatment, descaling, and monitoring system can be automatically scheduled, via wireless and network communications, and various service-related parameters and data can be continuously updated, by service personnel and service organizations, in order to facilitate compliance with service schedules, including dynamically changing service schedules. In essence, the presently disclosed water-treatment, descaling, and monitoring systems assume large portions of the burden for water monitoring and water treatment being shifted from water utilities to water-utility clients due to the many problems, discussed above. The presently disclosed system can also adjust water-filter components of the system in response to alerts from local water utilities. The presently disclosed system enables measurement probes to be mounted in water for years without service by preventing lime scale build-up on water contact surfaces of measurement probes.

One or more relay controllers 416 may be internally incorporated within the control unit or may be connected, via wiring or wireless communications, to the control unit. Signals transmitted by the one or more microprocessors to relay controllers can activate and/or deactivate various different types of devices and systems. For example, relay controllers may be activated to open garage doors, activate physical alarms, turn lights on and off, activate and deactivate well pumps, turn off and turn on valves, activate automatic doors, throw circuit breakers, and carry out other types of tasks warranted by the detection of problems and concerns by the control logic of the presently disclosed water-treatment, descaling, and monitoring system.

Serial interfaces 418 provide access to the one or more microprocessors 404 and memory devices 406. In the implementation shown in FIG. 3, the serial interfaces may be accessed by service personnel through the door of the optionally locked compartment 316 in order to locally download parameter values and firmware/software routines and programs to the control unit, invoke execution of firmware/software routines, and run diagnostic routines.

The descaler module 420, discussed in more detail, below, generates a descaling signal, in many implementations, to remove and prevent lime scale. The descaling signal may also remediate bacterial and pathogen build-up. In addition, descaler module 420 may generate a signal to inhibit electrolysis. As discussed above, the descaling signal is conducted through water in water pipes and appliances in order to remove, and inhibit subsequent deposition of, limescale. In one implementation, the descaling signal is a sine-wave-like radio-frequency ("RF") signal with a frequency of 142.5 kHz and a peak-to-peak voltage ("Vpp") of 21 V. Of course, descaling signals with frequencies in the range of 50-148 kHz and Vpp values in the range of 5V to 50V or more can be generated by modifying implementation parameters, while still meeting FCC requirements, published under Title 47 by the Government Printing Office, and European Union directives related to health, safety, and environmental-protection standards for products sold within the European Economic Area, compliance with which is indicated by a CE mark. The phrase "pure sine wave" refers to a sine wave with no harmonics. The phrase "sine-wave-like" is used to indicate that the descaling signal may have a wave form slightly different from that of a pure sine wave. As discussed above, the descaler module is hardwired or magnetically coupled 422 to a water pipe 424 or appliance in order to input the descaling signal into the water within the water pipe or appliance.

The probe signal-conditioning circuits 426 provide interfaces to the output of probe/sensor transducers in order to receive transducer output from the probe/sensors and convert the transducer output into signals compatible with input interfaces of the one or more microprocessors. Signal-conditioning circuits can carry out a variety of different operations on the received transducer outputs. These may include bandpass filtering, amplification of low-voltage outputs, attenuation of high-voltage outputs, amelioration of voltage spikes, and analog-to-digital signal conversion. In addition, signal-conditioning circuits can serve to isolate the transducers from the one or more microprocessors and, in certain cases, input activation signals to probes and sensors needed for output generation.

The water-treatment, descaling, and monitoring systems may include a variety of different types of probes and sensors 430-432. Examples of sensors and probes used in various implementations include: (1) pressure, differential-pressure, and flow-rate probes; (2) TDS, total-dissolved-solids probes which measure ion concentrations; (3) pH sensors; (4) TOC, total-organic-carbon probes, which detect UV absorption which can be, in part, proportional to concentrations of proteins and other UV-absorbing molecules in water; and (5) ORP, oxidation-reduction-potential sensors, which provide indications of chlorine levels. Probes are used for monitoring water quality, remaining filter capacity, component malfunctions, and for other operational-status determinations. As mentioned above, certain implementations of the presently disclosed water-treatment, descaling, and monitoring systems are designed for straightforward addition of new types of probes and sensors to existing water-treatment, descaling, and monitoring systems. Addition of a new type of probe or sensor may involve physically connecting the probe to the monitoring environment in which it operates, connecting probe output to an unused or multi-input signal-conditioning-circuit interface or adding a supplementary signal-conditioning circuit, and downloading appropriate firmware/software routines for processing signals input from the probe via signal-conditioning circuitry.

The presently disclosed water-treatment, descaling, and monitoring systems generally employ one or more pre-filters 440 and one or more additional water-treatment filters 442. Various different types of pre-filters may be used. Pre-filters generally include relatively coarse membranes or other mechanical filters or sieves in order to trap various types of macroscopic debris and contaminants, including rocks and gravel, plant debris, dirt, sand, and other debris and contaminants. Many different types of water-treatment filters may be used, including catalytic carbon water filters containing activated coconut carbon impregnated with ferric oxide/hydroxide.

The presently disclosed water-treatment, descaling, and monitoring systems generally include a descaler, as discussed above, which generates electrical descaling signals that are input to water within plumbing and appliances. These same signals can potentially interfere with operation of various types of water-treatment filters, including the above-mentioned catalytic carbon water filters and additional types of water filters mentioned below. However, the presently disclosed water-treatment, descaling, and monitoring systems employ a descaler designed to produce very pure, oscillating signals of a particular frequency or frequency range with little or no harmonic distortion. The descaling signal is equally above and below ground and thus averages to 0 volts and hence does not interfere with operation of catalytic carbon filters. The descaling signal can also potentially interfere with sensor and probe readings, but the control routines can halt decaling-signal production immediately prior to and during reading of sensor and probe output, in order to avoid the descaling signal overwhelming and/or distorting sensor readings. The presently disclosed descaler also prevents lime scale from building up on electrically conductive or photo-optic surfaces of probes and sensors. This enable probes and sensors to be left unattended in hard water for many years, instead of the normal few months.

Figure 5:
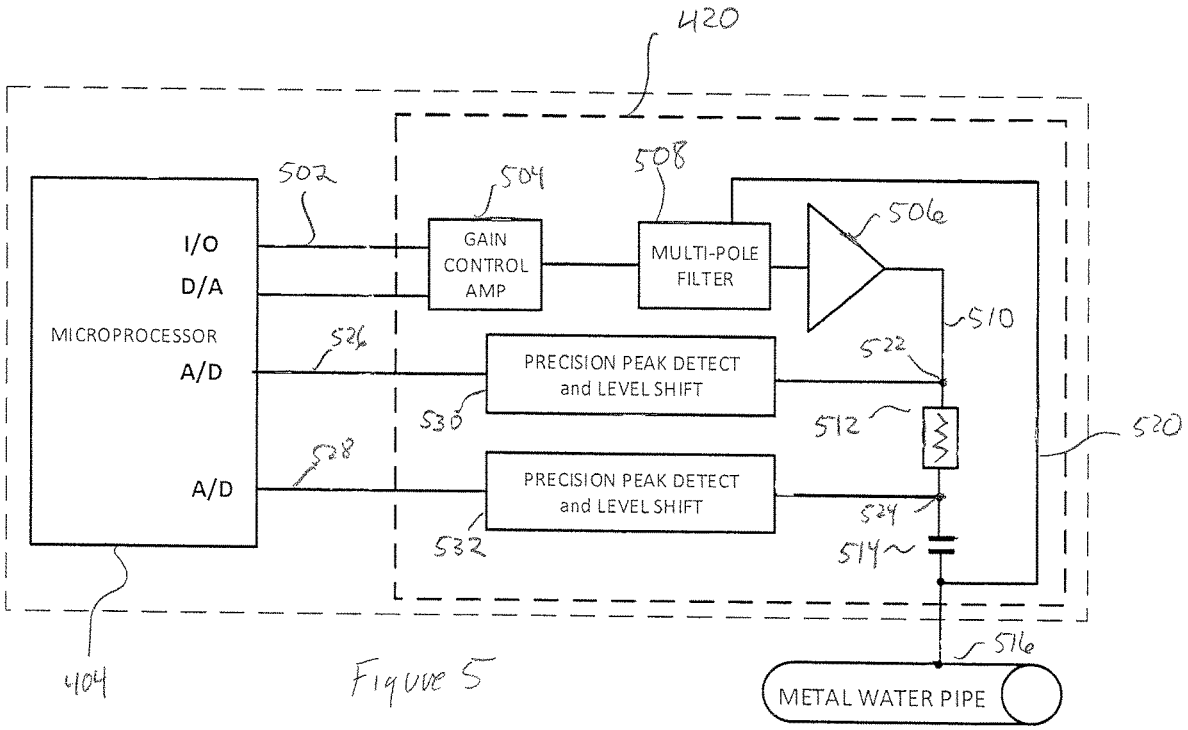
FIG. 5 illustrates the descaler module (420 in FIG. 4) at a greater level of detail than shown in FIG. 4.

FIG. 5 illustrates the descaler module (420 in FIG. 4) at a greater level of detail than shown in FIG. 4. The microprocessor 404 is shown at the left of the descaler module 420. A descaler-signal-generation routine executing on the microprocessor generates a square-wave signal at the desired descaling frequency, which is output via signal line 502 to a gain-control amplifier 504 within the descaling module 420. The gain-control amplifier adjusts the amplitude of the square wave in order to achieve a desired amplitude range of the descaling signal output from the power amplifier 506. Output from the gain-control amplifier is input to a multi-pole filter 508, which converts the input square-wave signal to a smooth sinusoidal output signal that is input to the power amplifier. In one implementation, a 5-pole multi-pole filter 508 is used.

The descaling signal 510 output from the power amplifier passes through resistor 512 and capacitor 514 to a hard-wired or magnetic-coupling connection 516 to metal pipe 518 or 1706. The signal is fed back, via signal line 520, to the multi-pole filter 508, which allows the descaler module to adapt to a variety of different combinations of resistive, inductive, and capacitive loads of the plumbing system, while preserving a pure, undistorted sine-wave-like signal. The resistor 512 provides, at high current levels, a significant voltage drop between points 522 and 524. This voltage drop is detected by monitoring routines that execute on the microprocessor from comparison of the signals 526 and 528 output by precision-peak-detection circuits 530 and 532. The precision-peak-detection circuits generate relatively low-voltage direct-current ("DC") signals with voltages that are proportional to the peak amplitudes of the descaling signal prior to, and following, passage of the descaling signal through resistor 512. When the plumbing or appliance 518 is not grounded, the descaling signal is transferred into the water within the plumbing or appliance. Because water has relatively high resistance to conduction of electric currents, when the plumbing or appliances are not grounded, relatively little current flows into the water, due to the high resistance of the water, as a result of which the voltage drop across resistor 512 is very small. By contrast, when the connection pipe is grounded, the voltage 512 is dropped across the resistor, leading to a significant voltage drop detectable by the monitoring routines running within the microprocessor. By continuously or periodically comparing the difference in voltage of output signals 526 and 528, the control unit of the presently disclosed water-treatment-and-the monitoring system is able to detect when the descaling signal is not being effectively transferred to the water, and can then locally and/or remotely raise alarms to alert residents, building occupants, installers, service-organization personnel, and others as well as take additional actions, including sending communications messages to service organizations and others. Thus, precision-peak-detection circuits 530 and 532 and continuous or periodical comparison of the difference in voltage of output signals 526 and 528 together comprises a type of probe that monitors the operational state of the descaler module 420. Capacitor 514 acts as a level shift in order to center the voltage oscillations of the descaling circuit about the reference potential of the plumbing or appliance 518, thus avoiding interfering with operation of the catalytic carbon water filters.

Figure 6:
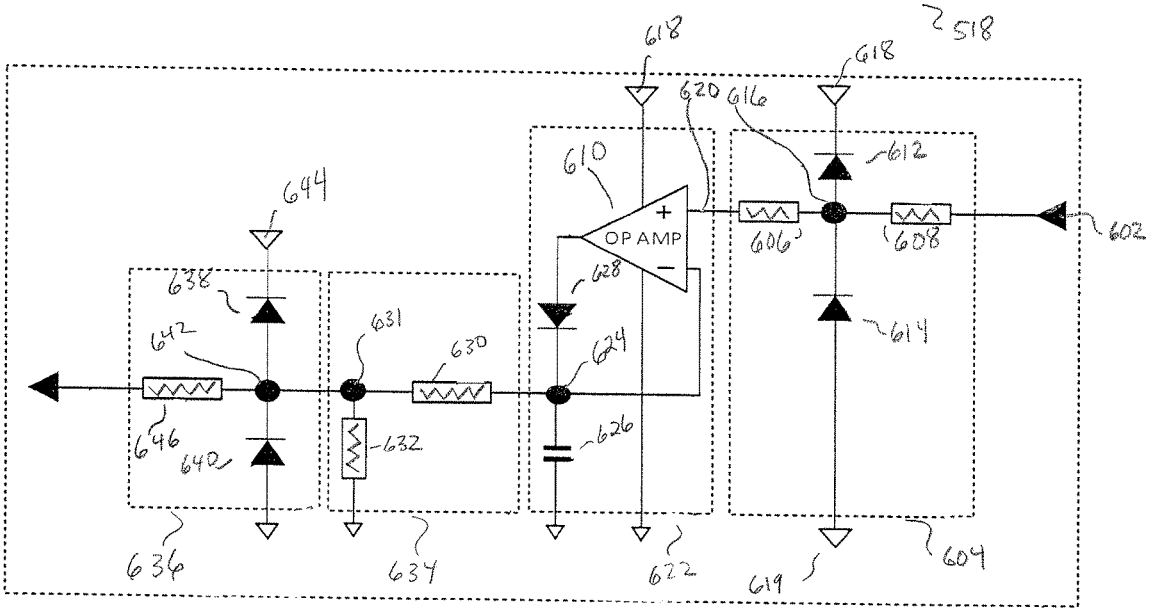
FIG. 6 illustrates the precision-peak-detection modules (530 and 532 in FIG. 5).

FIG. 6 illustrates the precision-peak-detection modules (530 and 532 in FIG. 5). Symbol 602 represents input of the descaling signal from one of points 522 or 524 in FIG. 5. The descaling signal is input initially to an input-protection circuit 604 that protects OP AMP input 620 from over-voltage inputs. The total impedance of resistors 606 and 608 is much less than the input impedance of op amp 610. Diodes 612 and 614 together comprise a clamp circuit that prevents the voltage at point 616 from rising above the sum of the analog power-supply voltage 618 and the diode-drop voltage of 0.7V and falling below ground 619 minus the diode-drop voltage of 0.7V. Resistor 608 protects diodes 612 and 614 from current overload. Resistor 606 protects the op amp 610 from current overload. Output 620 from the input-protection circuit 604 is directed to the non-inverting input of the op amp 610 within a next precision-peak-detector circuit 622. The precision-peak-detector circuit stores the peak voltage value of the input descaling signal at point 624. The input descaling signal charges capacitor 600 to a voltage value within a few millivolts of the peak value of the descaling circuit. When the voltage of the input descaling signal falls below the peak value, output from the op amp reverse biases diode 628, so that the stored peak value is maintained at point 624. The stored peak value is input through the resistor 632 point 631. Point 631 is connected to ground through resistor 632. Because capacitor 626 is connected to ground through the pair of resistors 630 and 632, capacitor 626 will slowly discharge so that the stored peak value 624 can dynamically follow decreases in the peak voltage of the descaling circuit. Of course, the sum of the impedances of these resistors must be sufficiently large that the discharge time for the capacitor is significantly greater than the interval, in time, between consecutive peaks of the descaling circuit, for example, 7 microseconds. The pair of resistors 630 and 632 also act as a level-shift circuit to scale down the stored peak voltage to a value between the reference voltages for the analog-two-digital ("A/D") converters of the microprocessor that receive signals 526 and 528, as shown in FIG. 5. Thus, pair of resistors 630 and 632 comprises a level-shift and slow-capacitor-discharge circuit 634. The level-shifted peak voltage is then input to a micro-protection circuit 636 with a pair of diodes 638 and 640 which operate to clamp the voltage at point 642 to a voltage between the sum of the digital-power-supply voltage 644 and the diode-drop voltage of 0.7V and ground 619 minus the diode-drop voltage of 0.7V. Resistor 646 protects the A/D-converter input of the microprocessor from current overload.

Figure 7:
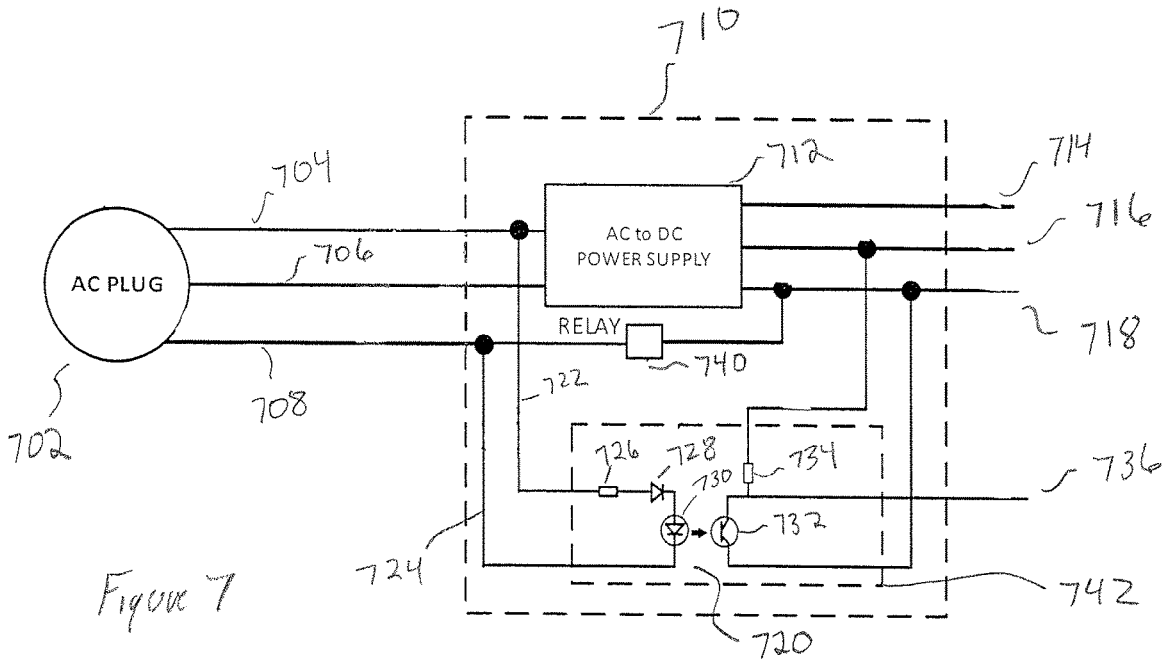
FIG. 7 shows the power-supply module (408 in FIG. 4) in greater detail.

FIG. 7 shows the power-supply module (408 in FIG. 4) in greater detail. The power supply module receives power from an AC power plug 702. There are three wires in a power cord: (1) the hot wire 704; (2) AC return 706; and (3) AC safety ground, also referred to as the "green wire" 708.

The power-supply module 710 includes an AC-to-DC power supply 712 which receives hot 704 and AC-return 706 inputs and outputs analog power supply 714, digital power supply 716, and ground 718. Optical isolator 720 receives hot 722 and AC-safety-ground 724 inputs. The hot input passes through resistor 726 and diode 728 to photodiode 730. When AC ground is present, AC current passes through photodiode 730 producing quickly flashing light pulses. A photosensitive transistor 732 is activated by the light and, when activated, pulls current from digital-power-supply output 716 through resistor 734 and produces an oscillating voltage signal on the AC-safety-ground-status output 736 in response to the flashing light pulses produced by the photodiode. However, when AC ground is not present, the photodiode produces no light, as a result of which a constant voltage Vdd is output by the AC-safety-ground-status output 736. Relay 740 is set to an open position, by monitoring routines running on the microprocessor, for testing AC-safety-ground status. When the power-supply module is located within the descaler, the hot and AC safety ground is provided to the safety-ground-detection circuit 742 via a cable. In this case, for safety reasons, the voltage within this cable is reduced. The AC-safety-ground-status output is directed to the microprocessor which monitors the AC-safety-ground status and controls the front-panel display (402 in FIG. 4) to display indications of AC-safety-ground status and controls the relay controllers (416 in FIG. 4), and/or the communications interface (410 in FIG. 4) to generate warnings signals or warning messages when AC safety ground is not properly functioning.

Figure 8:
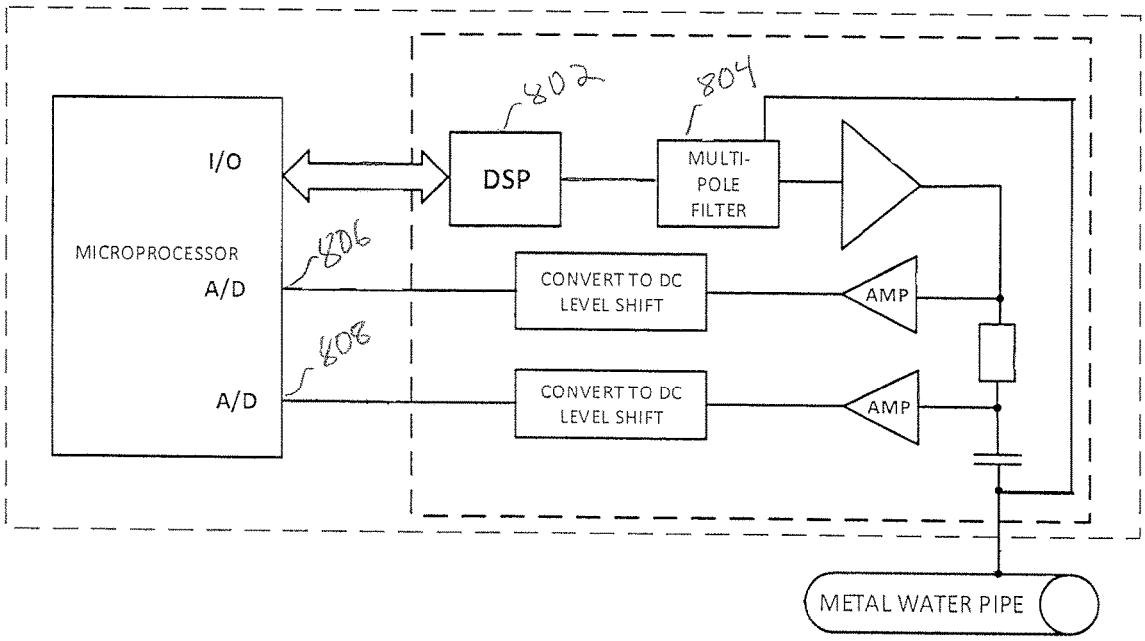
FIG. 8 illustrates an alternative descaler-module implementation.

FIG. 8 illustrates an alternative descaler-module implementation. This implementation generates a constant-amplitude descaling signal with varying frequency. This type of descaling signal has been shown to be more effective in removing limescale and biofilm. The varying frequency ranges from 50 kHz to 550 kHz, in certain implementations. Frequency variation may constitute continuous sweeps through the frequency range or may be abruptly changed to produce various different deterministic or random patterns of frequencies, in time. Comparison of FIG. 8 to FIG. 4 reveals that the primary difference between the alternative implementation shown in FIG. 8 and the original implementation shown in FIG. 4 is the presence of a digital signal processor ("DSP") 802. The scaling-signal-generation routines executing on the one or more microprocessors program the DSP to produce oscillating descaling signals with particular amplitudes and frequencies. Because the amplitude of the signal output from the multi-pole filter 804 varies with the frequency of the signal output by the DSP, the descaler-generating routines running within the microprocessor monitor the peak voltage of the descaling signal, via one or more of inputs 806 and 808, and accordingly adjust the amplitude of the signal output by the DSP in order to maintain a constant-amplitude descaling signal. Multi-frequency descaling signals have two major advantages: (1) multi-frequency outputs enable the descaling signal to be sent at a series of different frequencies and to therefore avoid concentrating the descaler output signal at a single frequency which, in turn, reduces the average output energy at each given frequency and enables a powerful descaling signal to pass FCC regulations; and (2) multi-frequency descaling signals are more effective at controlling bio-film, because it is more difficult for bio-film organisms to adapt to a descaling signal that constantly changes in frequency.

Figure 9:
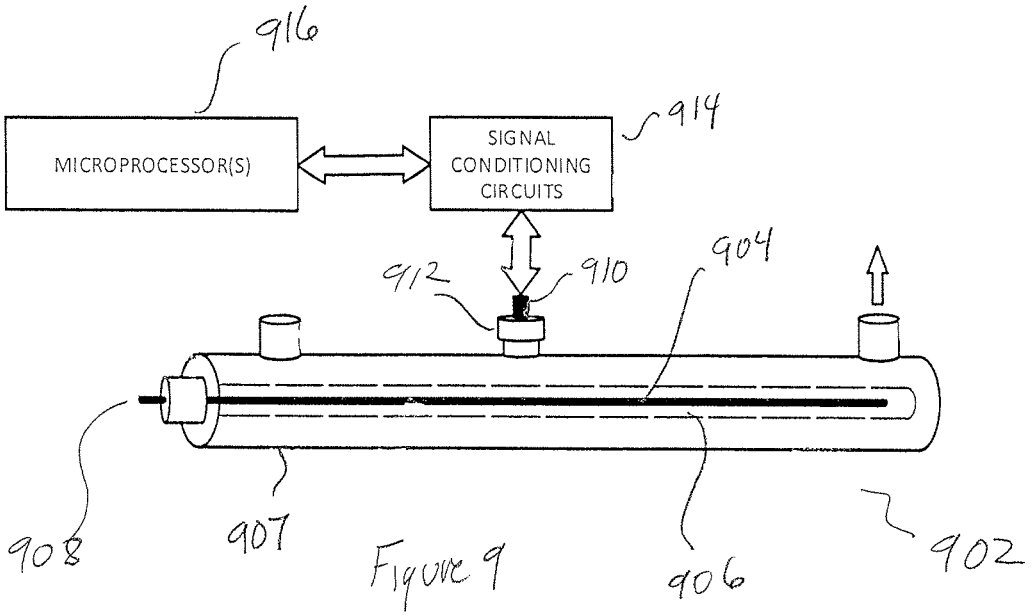
FIG. 9 illustrates a UV disinfection canister used in certain implementations of the presently disclosed water-treatment, descaling, and monitoring system to reduce or eliminate biological contaminants.

FIG. 9 illustrates a UV disinfection canister used in certain implementations of the presently disclosed water-treatment, descaling, and monitoring system to reduce or eliminate biological contaminants. The UV disinfection canister 902 includes a UV-radiation-generation element 904 within a UV-transparent tube 906, mounted within a canister 907 and powered by input from the analog-power-supply 908 or by AC power. A UV sensor 910 response to impinging UV radiation through a UV-transparent window and port. Output from the UV sensor is directed to a probe-signal-conditioning circuit 914 (426 in FIG. 4), which converts the UV-sensor output to a signal monitored by the one or more microprocessors 916 (404 in FIG. 4). Various types of failures may occur, including coating of the UV-transparent tube 906 by limescale, failure or degradation of the UV-radiation-generation element, and other failures. When the UV-sensor fails to detect impinging UV radiation, or when the intensity of the impinging UV radiation falls below a threshold level, monitoring routines executing within the microprocessor respond by one or more of displaying indications of UV-canister status, controlling one or more relay controllers (416 in FIG. 4), and/or the communications interface (410 in FIG. 4) to generate warnings or warning messages. The presently disclosed water-treatment, descaling, and monitoring system not only monitors the UV output of UV canister 907, but also prevents limescale from covering the UV tube 906 with an opaque covering that prevents UV light 904 from treating the water for pathogens. Depending on the hardness of the water, a limescale coating sufficient to block UV light can form in a few months without the descaling signal output by the descaler module (420 in FIG. 4).

Electronic devices emit radio waves, referred to as "electromagnetic interference" ("EMI"). Federal Communications Commission ("FCC") regulations set maximum limits on EMI emissions of electronic devices in order to minimize inference with wireless communications. FCC regulations apply to all frequencies between 9 kHz and 275 GHz). FCC regulations are much less restrictive below 150 kHz, than above 150 kHz. Many presently available descalers use low-voltage descaling signals with low duty cycles in order to maintain radio-frequency ("RF") emissions from the descalers below maximum levels specified by the FCC. This is because descaling signals produced by the presently available descalers include significant harmonic distortion. These low-peak-two-peak-voltage descaling signals with low duty cycles generally do not transfer sufficient energy into the water contained in pipes and appliances to effectively and quickly dissolve limescale and are often attenuated to ineffective levels before reaching a significant portion of the plumbing and appliances for which descaling is desired. The presently disclosed descaler modules and water-treatment, descaling, and monitoring systems address these problems by outputting a relatively strong, continuous sine-wave-like descaling signal, with a 100% duty cycle at 142.5 kHz, that is compliant with both FCC regulations and EU directives. This much stronger descaling signal has been shown to travel further and is significantly more effective for descaling purposes, showing visible results in days instead of months.

The present invention generates a square wave at digital output (502 in FIG. 5) of microprocessor (404 in FIG. 5). This square wave has an amplitude of about 4 volts with a fundamental frequency of 142.5 kHz. The descaling module (420 in FIG. 5) outputs a descaling signal of about 21 peak-to-peak voltage ("Vpp"). Thus, the descaling module amplifies and smooths the 4-volt square wave output by the microprocessor, greatly reducing harmonic distortion comprising signals at frequencies that are multiples of the fundamental frequency of the input signal. Square waves and other periodic waveforms can be mathematically generated by Fourier series, which as composed of harmonically related sinusoids, combined by a weighted summation. One Fourier-series representation of a square wave comprises a combination of weighted sine waves, including a pure sine wave at the fundamental frequency and an infinite series of sine waves with frequencies at odd multiples of the fundamental frequency and with amplitudes that decrease with increasing frequency. A finite Fourier series with a sine wave of a fundamental frequency f=142.5 kHz, the frequency of the square wave produced by the microprocessor of the above-described implementation of the presently disclosed descaler module, and a finite series of harmonics of frequencies 3f, 5f, 7f . . . , nf, is used to model the descaling signal, as indicated in the following table:

| Square Wave = | Fundamental Pure Sine Wave + | Sum of Odd Harmonic Sine Waves |
|---|---|---|
| Vsw (f) = | Vo (f) + | (1/3) Vo (3 f) + (1/5) Vo (5 f) + (1/7) Vo (7 f) + (1/9) Vo (9 f) + (1/11) Vo (11 f) + . . . + (1/n) Vo (nf) |

Where:
Vsw = amplitude of square wave,
f = frequency of square wave = 145.5 kHz in present disclosure,
Vo = amplitude of fundamental pure sine wave with frequency = f, and
nf = the frequency of the highest-frequency harmonic in the finite series.

Certain of the harmonic component sine waves are in the AM radio band. The harmonic distortion comprises a set of component sine-wave signals with frequencies selected from the above listed multiples of the fundamental frequency f and with amplitudes generally smaller than the fundamental-frequency component and generally decreasing with increasing frequency. The descaling module reduces harmonic distortion by using a multi-pole filter (508 in FIG. 5), to produce a sine-wave-like signal descaling signal of the fundamental frequency in order to prevent RF emissions greater than those permitted by the FCC and European directives.

Even more powerful descaling signals can be generated at multi-frequencies using a digital signal processor ("DSP") 802, spreading the generated output over several frequencies, which add together to remove and prevent lime scale, but which are measured separately for FCC purposes. The various types of circuit components, including operational amplifiers, microprocessors, and other circuit components, have various limitations and are less than ideal components. Thus, all circuit filter designs must have margin for error to account for these less than ideal components. There are additional sources of EMI in the presently described descaler module and water-treatment, descaling, and monitoring system. The DC analog power supply generally exhibits RF noise output, referred to as "ripple." Capacitors are used near DC analog power inputs to each amplifier to reduce EMI noise from the power supply.

Figure 10A:
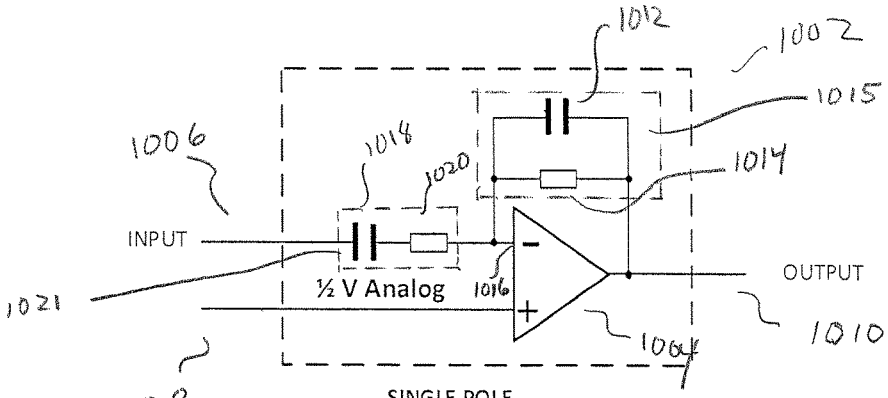
FIGS. 10A-B illustrates the multi-pole filter (508 in FIG. 5) in greater detail.
Figure 10B:
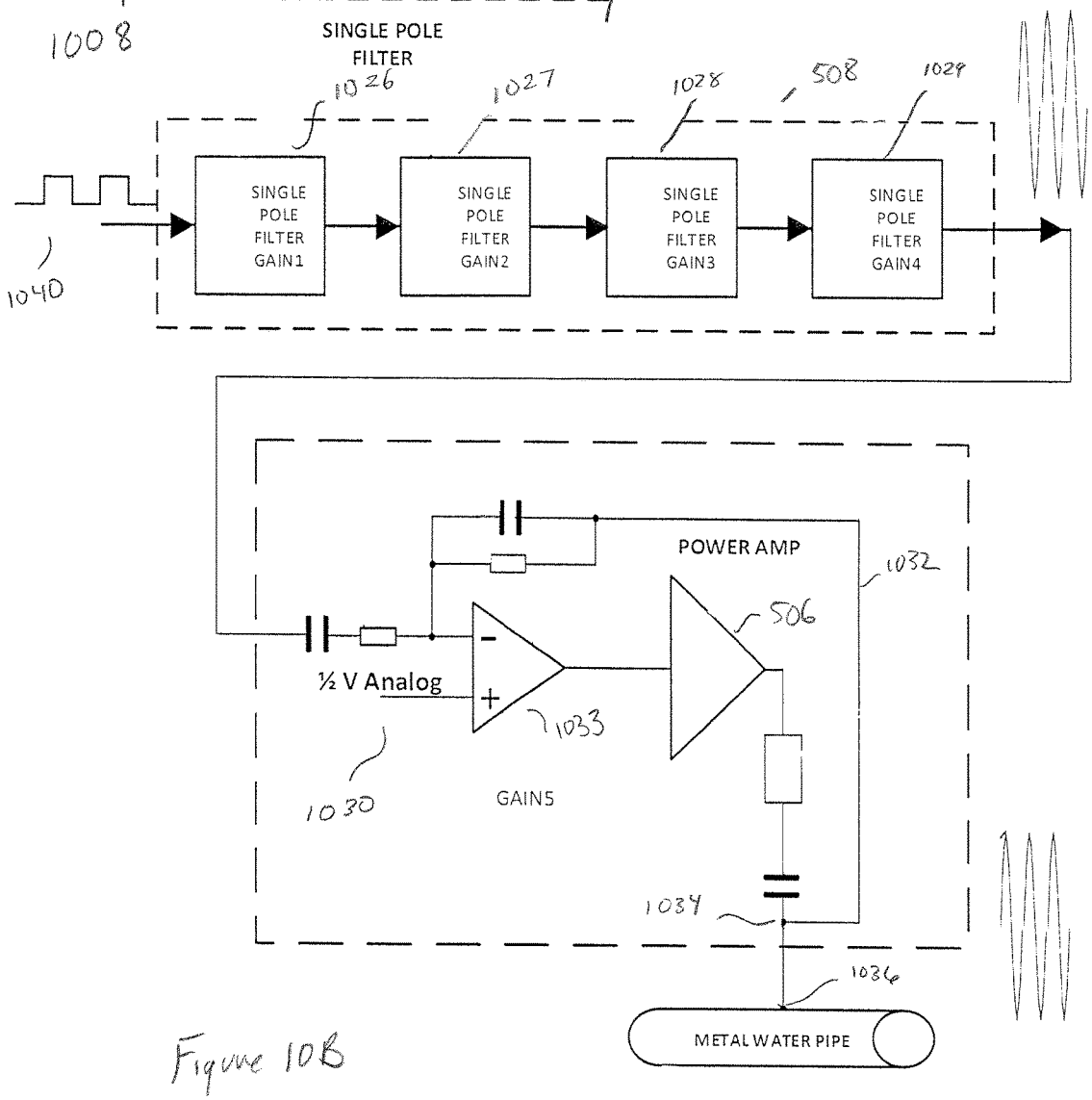

FIG. 10A-B illustrate the multi-pole filter (508 in FIG. 5) in greater detail. FIG. 10A shows a single-pole filter 1002. The single-pole filter includes an op amp 1004 that receives an input oscillating-voltage signal and an input direct-current signal 1008 and outputs a smoothed and frequency-filtered output signal 1010. Output from the op amp is fed back through a parallel capacitor 1012 with capacitance $C_2$ and resistor 1014 with resistance $R_2$, referred to below as sub-circuit P 1015, to the inverting input 1016 of the op amp. The input signal 1006 passes through a capacitor 1018 with capacitance $C_1$ and resistor 1020 with resistance $R_1$, in series, referred to below as sub-circuit S 1021, to the inverting input 1016 of the op amp. The magnitude of the impedance Z, |Z|, for sub-circuit P is:

$$|Z_P| = \frac{1}{\sqrt{\left(\frac{1}{R_2}\right)^2 + (\omega C_2)^2}}$$

and the change in phase angle for sub-circuit P is:

$$\Delta\phi_P = \tan^{-1}(-\omega C_2 R_2),$$

where ω is the angular frequency 2πf corresponding to the frequency f of the input signal. The magnitude of the impedance Z, |Z|, for sub-circuit S is:

$$|Z_S| = \sqrt{R_1^2 + \frac{1}{(\omega C_1)^2}}$$

and the change in phase angle for sub-circuit S is:

$$\Delta\phi_S = \tan^{-1}\left(-\frac{1}{\omega C_1 R_1}\right).$$

The magnitude of the gain of the op amp is:

$$\frac{|Z_P|}{|Z_S|}.$$

As the frequency increases to ever larges values, $|Z_P|$ approaches 0 and, as the frequency decreases towards 0, $|Z_P|$ approaches $R_2$. As the frequency increases to ever larger values, $|Z_S|$ approaches $R_1$ and as the frequency decreases towards 0, $|Z_S|$, grows exponentially larger and approaches the impedance of C1 at the specified frequency. Thus, single-pole filter 1002 is a bandpass filter, with the effective frequency range passed by the single-pole filter controlled by the resistance and capacitance values $R_1$, $C_2$, $R_2$, and $C_2$. The single-pole filter also smooths portions of the input signal corresponding to rapid changes in voltage, such as the corners of a square-wave input. The smoothing effect is seen when the square wave is modelled by the above-discussed finite Fourier series, with the band-pass filter removing the harmonic sine waves, which are all at a higher-frequency and lower amplitude than the initial square wave.

FIG. 10B illustrates the multi-pole filter in greater detail. The multi-pole filter 508 includes a series of four single-pole filters, described above with reference to FIG. 10A, and a fifth modified single-pole filter 1030 in which the feedback signal 1032 to the inverting input of the op amp 1033 is returned from a point 1034 near the coupling 1036 of the descaling signal output by the descaler to a water pipe or appliance. This ensures that the descaling signal entering the plumbing system, despite varying loads represented by the plumbing system, is a pure sine-wave-like signal at a desired frequency of 142.5 kHz and a desired peak-to-peak voltage of 21 volts. The microprocessor-generated square wave 1040 is input to the first single-pole filter, or stage, of the multi-pole filter 1026, and each successive stage receives, as input, the output from the preceding stage. The resistance and capacitance values $R_1$, $C_2$, $R_2$, and $C_2$ of the first four stages are designed to pass the fundamental frequency of 142.5 kHz with a slight gain of around 1.5 while significantly attenuating the harmonic-distortion components with frequencies at multiples of the fundamental frequency as well as attenuating low-frequency signal components. The gains of the stages are multiplicative, so that the aggregate gain at the fundamental frequency for the first four stages is around 5. Successive filtering and smoothing by each successive stage transforms the input square wave into an almost pure sine wave of the fundamental frequency output by the final stage. The final stage adjusts the overall gain so that the power amplifier 506 outputs the desired descaling signal with Vpp=21V and with, of course, a frequency of 142.5 kHz.

Figure 11:
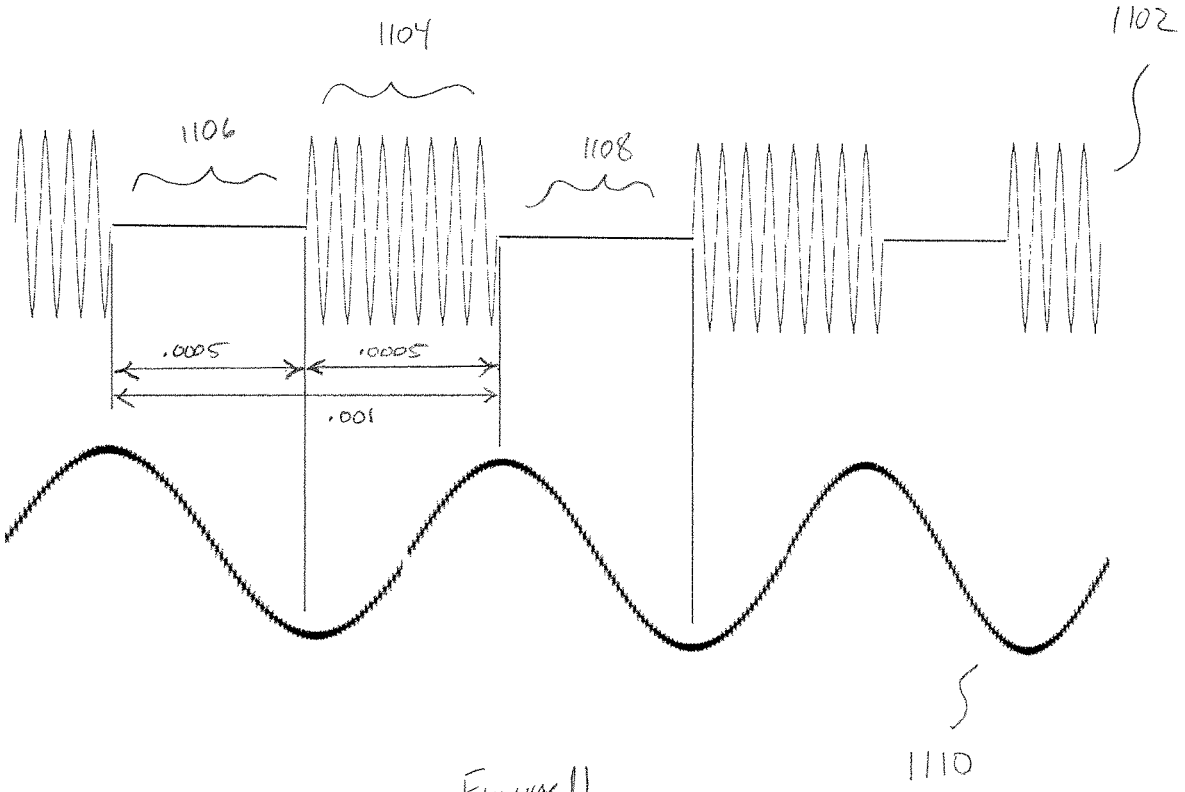
FIG. 11 illustrates modulation of the descaling signal to produce an audio-frequency signal that can be received and amplified by descaler-signal probe, discussed below.

FIG. 11 illustrates modulation of the descaling signal to produce an audio-frequency signal that can be received and amplified by descaler-signal probe, discussed below. As discussed above, in one implementation, the descaling signal has a frequency of 142.5 kHz. There are many sources for electric signals in the 50 kHz to 550 kHz range. Therefore, a probe designed to detect the 142.5 kHz descaling signal would likely detect many other electric-signal sources in the environment that would lead to many false positive readings. To address this problem, the presently disclosed descaler module (420 in FIG. 4) rapidly turns on and off the descaling signal in order to use the descaling signal as a modulated carrier wave that carries an audio-frequency signal. In FIG. 11, the rapidly turned-on and turned-off descaling signal is represented by curve 1102, with amplitude plotted with respect to time. Descaler-signal-on intervals, such as interval 1104, are interleaved with the descaler-signal-off intervals, including intervals 1106 and 1108. In one implementation, the lengths of both types of intervals is 0.0005 seconds. This approximates an oscillating audio-frequency signal 1110 with a frequency of 1/0.001=kHz. In one implementation, the control unit of the presently disclosed descaler module generates four different audio-frequency signals, including a high-frequency pair of 1.8 kHz and 2.2 kHz and a low-frequency pair of 1.0 kHz and 1.2 kHz. The signal pairs are alternated at between 1 and 2 seconds intervals. During each period, the signals of the present pair are alternated at between 0.25 and 0.5 seconds. This produces an easily recognizable and distinctive tone. The control unit can be directed to modulate the descaling circuit in this fashion through control features on the front-panel display, other types of control features, or via setting of parameters locally or remotely. As an example, a parameter can be set to modulate the descaling signal at selected intervals. As another example, the audio tones may be turned on for a time period after power up, after which normal descaler-signal output is resumed.

Figure 12:
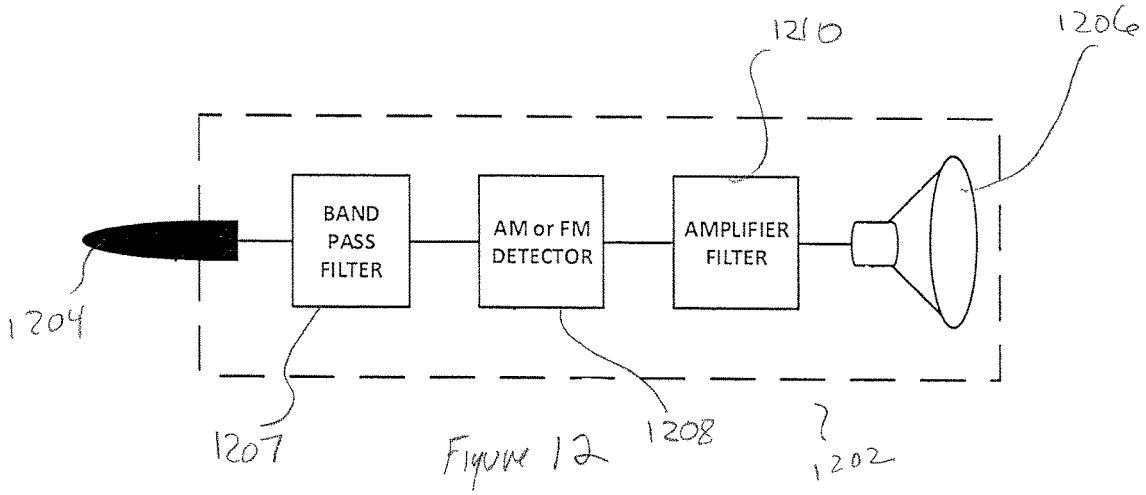
FIG. 12 illustrates a descaler tone probe.

FIG. 12 illustrates a descaler tone probe. The descaler tone probe 1202 is a battery-powered handheld device, in one implementation, with a probe tip that, when placed in contact with a metal or plastic water pipe or appliance, receives the modulated descaling signal, when present, and broadcasts an amplified audio signal through a speaker 1206. The probe tip 1204 capacitively or inductively couples the descaling signal to internal circuitry within the descaler tone probe, and is designed to have a very high impedance at the input to the band-pass-filter component 1207 within the descaler tone probe. The band-pass filter removes undesirable frequencies from the signals input from the probe tip. An AM or FM detector 1208 extracts the audio signal from the input signal and may also provide automatic gain control to adjust the amplitude range of the audio signal for amplification by amplifier 1210, which additionally removes unwanted audio tones. A descaler installer may employ the descaler tone probe to ensure that the descaler is properly installed and that the descaling signal is traveling through the water pipes throughout the plumbing system. A user may employ the descaler tone probe to determine points along the plumbing and appliances where a descaling signal of reasonable strength is present. This may aid a user in discovering where plumbing fixtures and/or appliances are shorted to ground, so that these problem points can be ameliorated in order that the descaling signal is carried throughout a desired portion of the plumbing and appliances. Many customers are skeptical that the descaling signal can travel through the water of plastic pipes. The descaler tone probe 1202 can be used to demonstrate, to a customer, that the descaler tone travels through the water in plastic as well as metal pipes.

Figure 13:
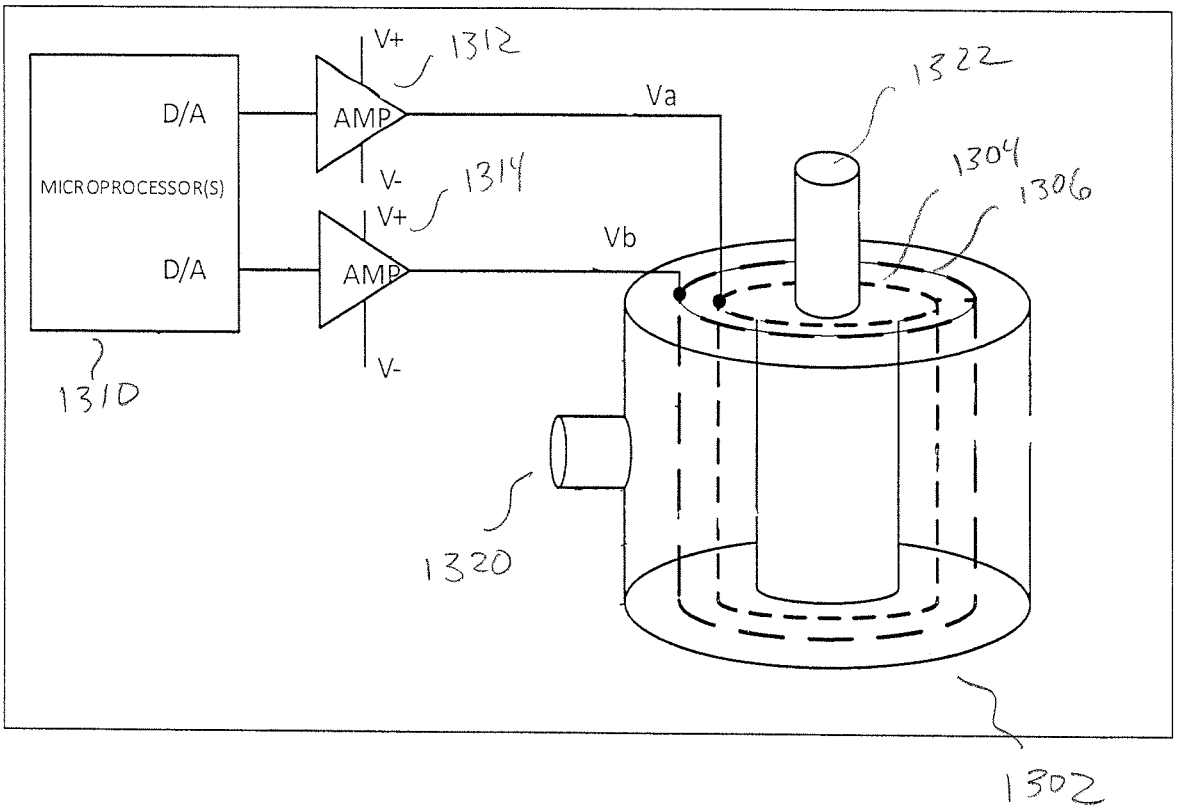
FIG. 13 illustrates an adjustable water-treatment filter.

FIG. 13 illustrates an adjustable water-treatment filter. In one implementation, the adjustable water-treatment filter is an activated-carbon filter 1302 which includes voltage-regulated cylindrical stainless or titanium wire meshes or other types of porous conductive material, such as porous carbon sheets, 1304 and 1306. In certain implementations, only a single voltage-regulated cylinder is used, while other implementations may include two or more voltage-regulated cylinders. Filter-adjustment routines executing within the one or more microprocessors 1310 (404 in FIG. 4) emit signals to one or more amplifiers 1312 and 1314 which are biased to output steady-state positive or negative voltages in order to establish the voltages of the voltage-regulated cylinders 1304 and 1306. Water is input through port 1320, spreads out through the internal volume of the filter 1302, and passes through the voltage-controlled cylinders before flowing out of the outlet port 1322. A positively charged cylinder efficiently attracts and traps negative ions and a negatively charged filter efficiently attracts and traps positive ions. The voltage difference between each pair of voltage-controlled cylinders must fall in the range (−0.82V, 0.82V) in order to prevent electrolysis of water to oxygen and hydrogen, where the parentheses indicate that negative voltages must be above −0.82V and positive voltages must be below 0.82V. When a single voltage-controlled cylinder is used, the difference between the cylinder voltage and ground needs to be in the same range. By adjusting the voltages applied to the adjustable filter, the filter can be adjusted to preferentially trap particular types of contaminants. Filter adjustment can be controlled locally, through the front-panel display (402 in FIG. 4) or serial interfaces (418 in FIG. 4), or remotely by receiving filter-adjustment indications and parameters via the communications interface (410 in FIG. 4). Thus, filter adjustments may be made by building owners and residents locally via control features provided on the front-panel display or remotely through smart phones or laptops. Filter adjustments can also be made by service personnel and even by water utilities or other organizations that monitor water conditions. Any of various different types of prefilters and water-treatment filters can be rendered adjustable, as described above.

Figure 14:
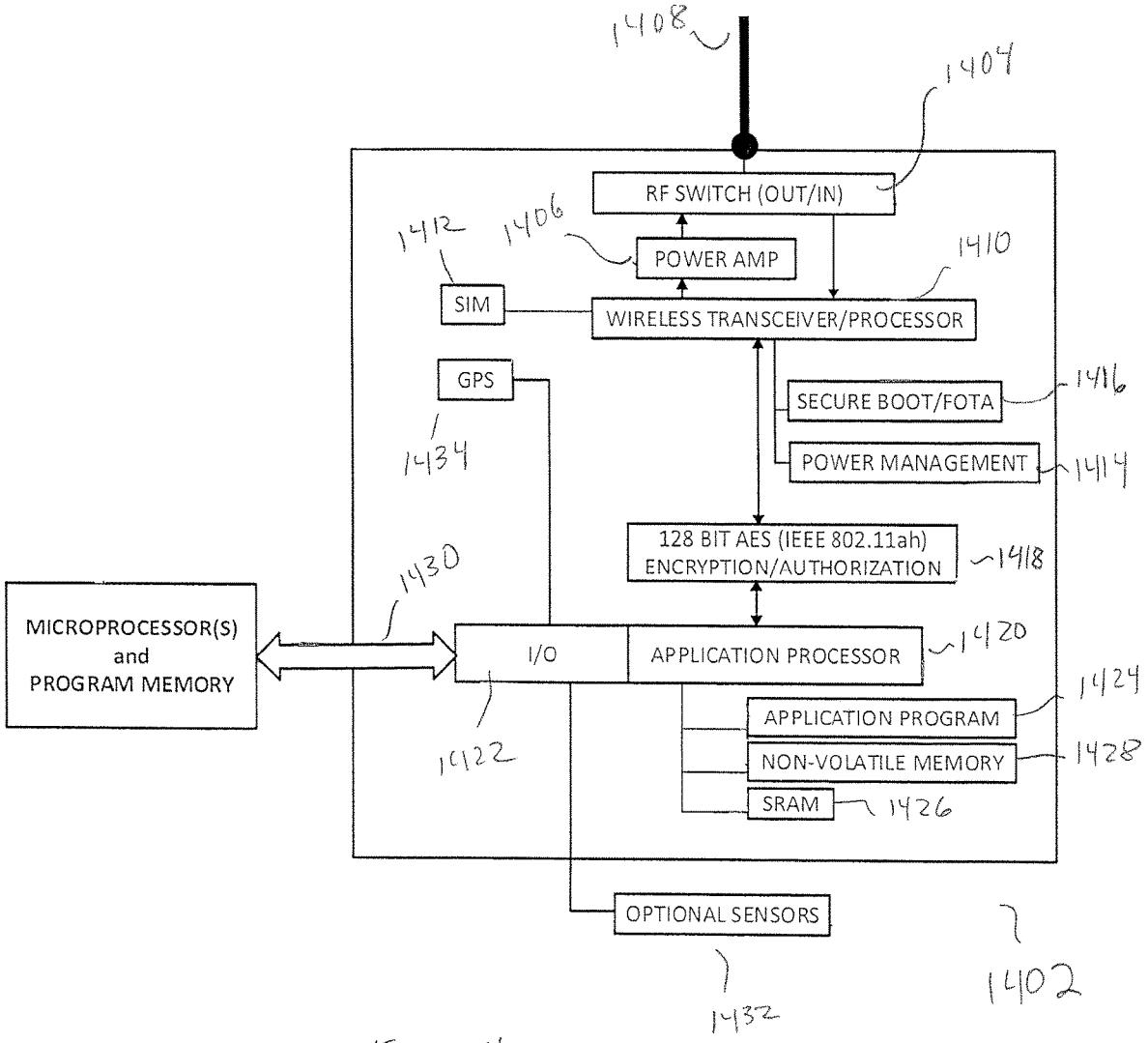
FIG. 14 illustrates one implementation of the communications interface (410 in FIG. 4).

FIG. 14 illustrates one implementation of the communications interface (410 in FIG. 4). In this implementation, the communications interface supports wireless communications. In certain cases, including when using the low-power ioT communications interfaces, wireless transmission is carried out in simplex mode, with the communications interface 1402 either receiving messages or sending messages at any point in time. RF switch 1404 switches between reception and transmission. Power amplifier 1406 is used to boost the RF output signal for transmission by the antenna 1408. The wireless transceiver/processor 1410 processes received signals and data for transmission according to any of the various communications types and protocols selected for transmission and reception, including Bluetooth, Wi-Fi, ioT, and smart-phone communications via the cellular network. In addition, the wireless transceiver/processor may execute power-management routines 1414 and routines that support Secure Boot and Firmware-Over-The-Air protocols 1416. The subscriber-identity-module ("SIM") card 1412 is used for cellular applications. The SIM card is a smart card that contains user identity information, user location information, a phone number, network-authorization data, and personal security keys, needed for access to the cellular network. Communications are secured via 128 bit Advanced Encryption Standard ("AES") encryption/decryption and authorization 1418, implemented either via routines running on the wireless transceiver/processor or by a special-purpose integrated circuit. Application processor 1420 is a general purpose processor, such as an ARM microprocessor (for example, an ARM Cortex-A5 (550 MHz) with I/O 1422 analog and digital interfaces. One or more application programs 1424 may be downloaded directly through application processor 1420 or may be downloaded from the Internet by the secure-boot routine 1416. The application processor accesses volatile memory 1426, non-volatile memory 1428, and I/O 1422. The application processor communicates with the control-unit microprocessor or microprocessors (404 in FIG. 4) via a communications medium 1430, such as a Serial Peripheral Interface ("SPI") or RS232 serial interface. The application processor can also access sensors 1432 and global-positioning-system output 1434 via the I/O controller 1422.

Figure 15:
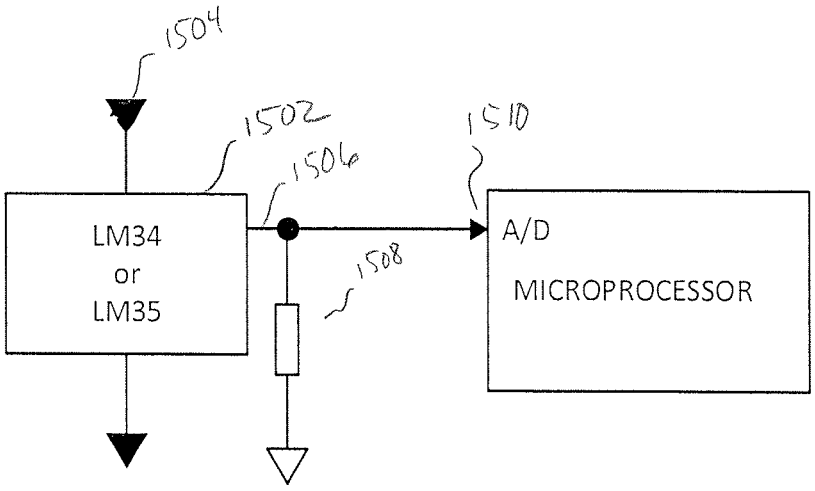
FIGS. 15-16 illustrate several different temperature sensors that may be incorporated within the presently disclosed water-treatment, descaling, and monitoring system.
Figure 16:
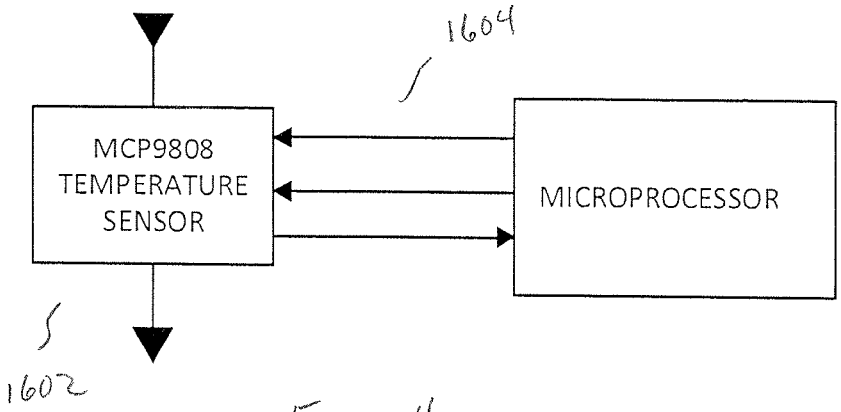

FIGS. 15-16 illustrate several different temperature sensors that may be incorporated within the presently disclosed water-treatment, descaling, and monitoring system. Temperature sensing is needed, in the presently disclosed water-treatment, descaling, and monitoring system, due to heat-producing circuitry within the control unit, including the power amplifier (506 in FIG. 5) and microprocessors (404 in FIGS. 4 and 1410 and 1420 in FIG. 14), in order to protect the internal circuitry from overheating. The temperature within the control unit may also need to be maintained above a low-threshold temperature value in order to prevent moisture condensation. Because the presently disclosed water-treatment, descaling, and monitoring system includes the ability to run sophisticated power-consumption-management routines within the various microprocessors included in the control unit, the control unit can sense rising temperatures within the control unit, using temperature sensors such as those shown in FIGS. 15-16, and take steps to lower power consumption until the temperature subsides below the high-threshold value. Power-consumption-lessening steps may include decreasing various monitoring intervals carried out by monitoring routines running on the one or more microprocessors, lowering of the average voltage of the descaling signal, intermittently discontinuing descaling-signal generation, intermittently placing the one or more microprocessors into low-power sleep modes, and various other such methods. Careful design is required, however, because the transient response to turning on and off the descaling signal may lead to FCC-compliance issues with radio interference. Similarly, power consumption can be increased by running microprocessors in full-processing modes, increasing the average voltage of the descaling signal, and by other similar means. In certain implementations, a series of thresholds may be used, with particular power-consumption-lessening approaches or power-consumption-increasing approaches taken when the present control-unit temperature is within each particular temperature range specified by an adjacent pair of thresholds.

FIG. 15 shows temperature-sensor integrated circuits incorporated within the presently disclosed water-treatment, descaling, and monitoring system. One or more temperature sensors (such as LM34 or LM35 integrated circuits) may be mounted on PCBs near circuit components that generate heat, such as power amp 506 shown in FIG. 5 and microprocessor 404 shown in FIG. 4. As shown in FIG. 15, the temperature sensor 1502 is connected to an analog power supply 1504 and outputs temperature data 1506 to an A/D microprocessor input 1510. Resistor 1508 connects to output 1506 and to a negative power supply to provide temperature readings below zero degrees, if necessary. Alternatively, the temperature-sensor output may be directed through the above-discussed probe-signal-conditioning circuits (426 in FIG. 4). The output voltage of the LM34 temperature sensor is proportional to the temperature in Fahrenheit degrees. The output of the LM35 is proportional to temperature in degrees Centigrade. For greater accuracy, as shown in FIG. 16, an MCP9808 temperature sensor 1602 is used. This temperature sensor has a bit serial interface that allows numerous temperature reading devices to be read by a small serial bus 1604 without need for A/D readings or A/D errors. Surface-mount packages provide good thermal contact with the PCBs and are available for the above temperature sensors.

Figure 17A:
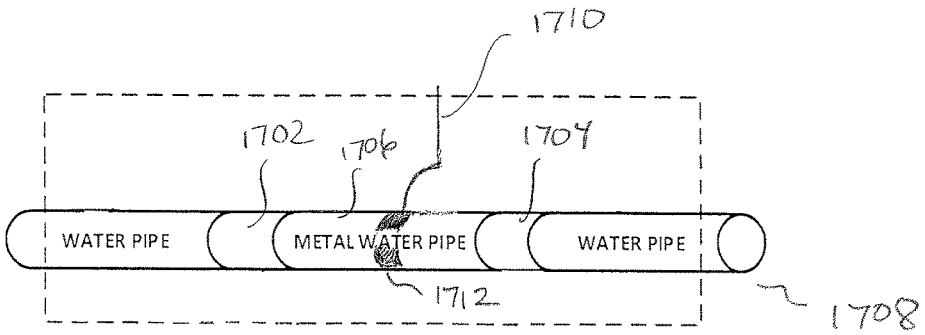
FIGS. 17A-B illustrate methods for transferring the descaling signal into water within plumbing and appliances.
Figure 17B:
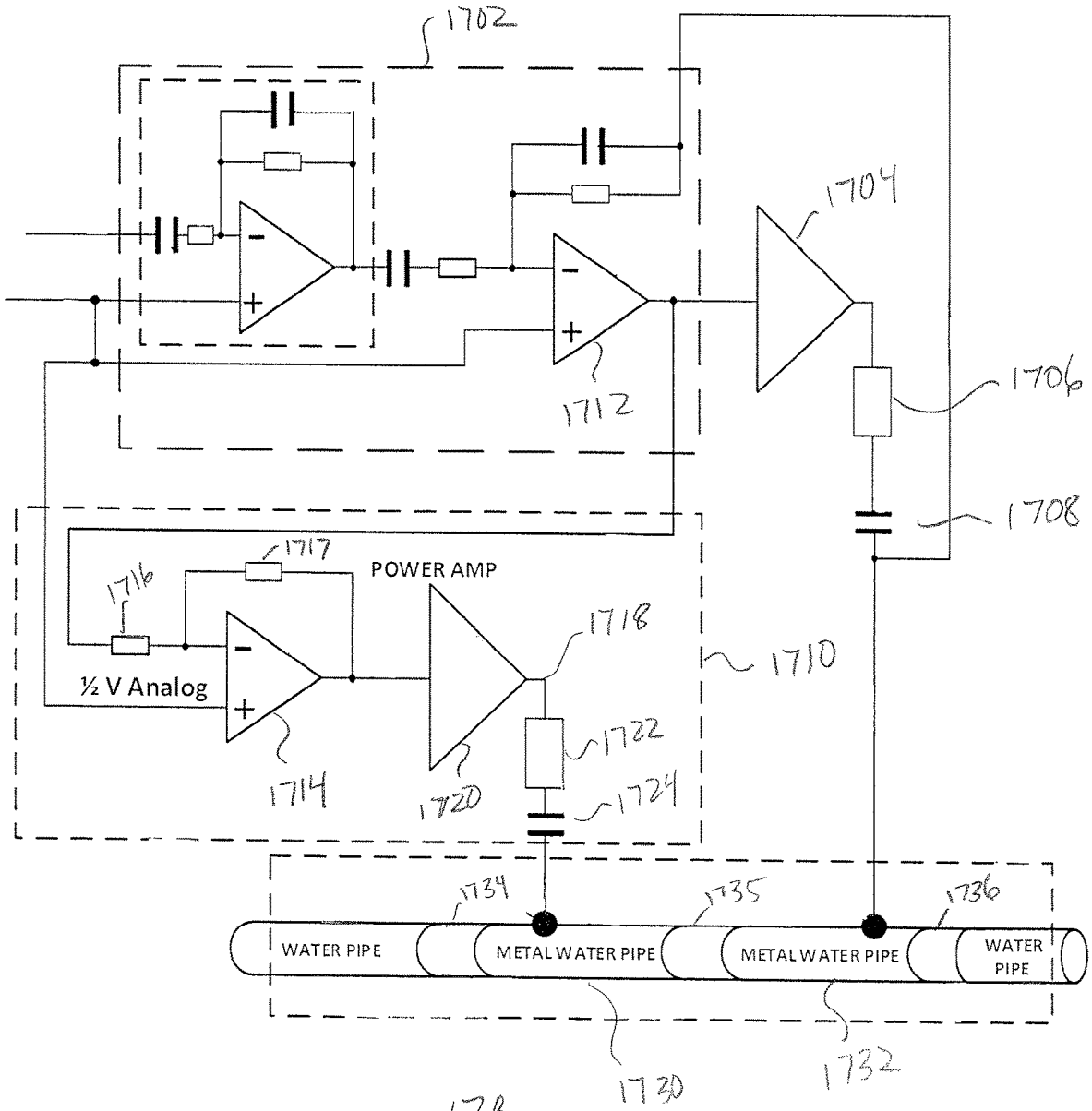

FIGS. 17A-B illustrate methods for transferring the descaling signal into water within plumbing and appliances. The FIG. 17A illustrates a presently used method. Two insulator regions 1702 and 1704 are placed on either side of the metal-pipe section 1706 within a metal water pipe 1708 in order to electrically isolate the metal-pipe section from the remaining metal portions of the water pipe that may be grounded. The descaling signal 1710 is input to a wire clamp 1712 that electrically connects the descaling-signal input to the metal-pipe section. The metal-pipe section needs to generally be about 10 inches long to provide optimal or near-optimal surface area for effective transfer of the descaling signal to the water within the pipe, with longer metal-pipe sections generally providing more efficient descaling-signal transfer.

FIG. 17B illustrates an alternative approach to transferring the descaling signal to water within plumbing and appliances. FIG. 17B shows a portion of the previously discussed multi-pole filter 1702 (1002 and FIG. 10), power amp 1704 (1020 in FIG. 10), resistor 1706 and capacitor 1708 (512 and 514 in FIG. 5), and a new signal-doubling circuit 1710. Output from the final amplifier 1712 (1022 in FIG. 10) of the multi-pole filter is directed to the inverting input of a first amplifier 1714 within the signal-doubling circuit. Output from the final amplifier 1712 of the multi-pole filter has the same amplitude and phase as output of power amp 1704. Resistors 1716-1717 and amplifier 1714 together comprise an inverting amplifier with a gain of opposite sign from the gain of power amplifier 1704. Thus, the signal 1718 emitted from power amplifier 1720 in the signal-doubling circuit is the mirror image, across the time axis, of the sine-wave-like descaling signal emitted by the power amplifier 1704. Power amplifiers 1704 and 1720 are identical, amplifier 1714 is very fast and there are no capacitors in the inverting-amplifier circuit, and resistor 1722 and capacitor 1724 are identical to resistor 1706 and capacitor 1708, so that the signal omitted from power amplifier 1720 is, indeed, an almost exact mirror image of the descaling signal emitted from power amp 1704. Since the signals are mirror images of one another, when the descaling signal emitted from power amplifier 1704 is at a positive peak, the signal emitted from power amplifier 1720 is it a negative peak, and vice versa. As a result, a combination of the two signals produces a descaling signal of the same frequency as the descaling signal emitted from power amplifier 1704, but with twice the amplitude. The two signals are combined, as shown in FIG. 17B, by connecting each signal to a separate metal-pipe section 1730 and 1732 isolated by insulating sections 1734-1736 from each other and from the remaining metal portions of the water pipe. As an added benefit, certain implementations which employ the signal-doubling circuit to double the amplitude of the descaling signal may function without access to AC safety ground. The signal-doubling circuit thus provides a much stronger descaling signal for more effective descaling operation within water systems, and because of the above-discussed feedback of the descaling signal to the final amplifier of the multi-pole filter, even the stronger descaling signal produced by the signal-doubling circuit remains free of distortion, so that the presently disclosed water-treatment, descaling, and monitoring system remains FCC compliant for radio emissions.

Figure 18:
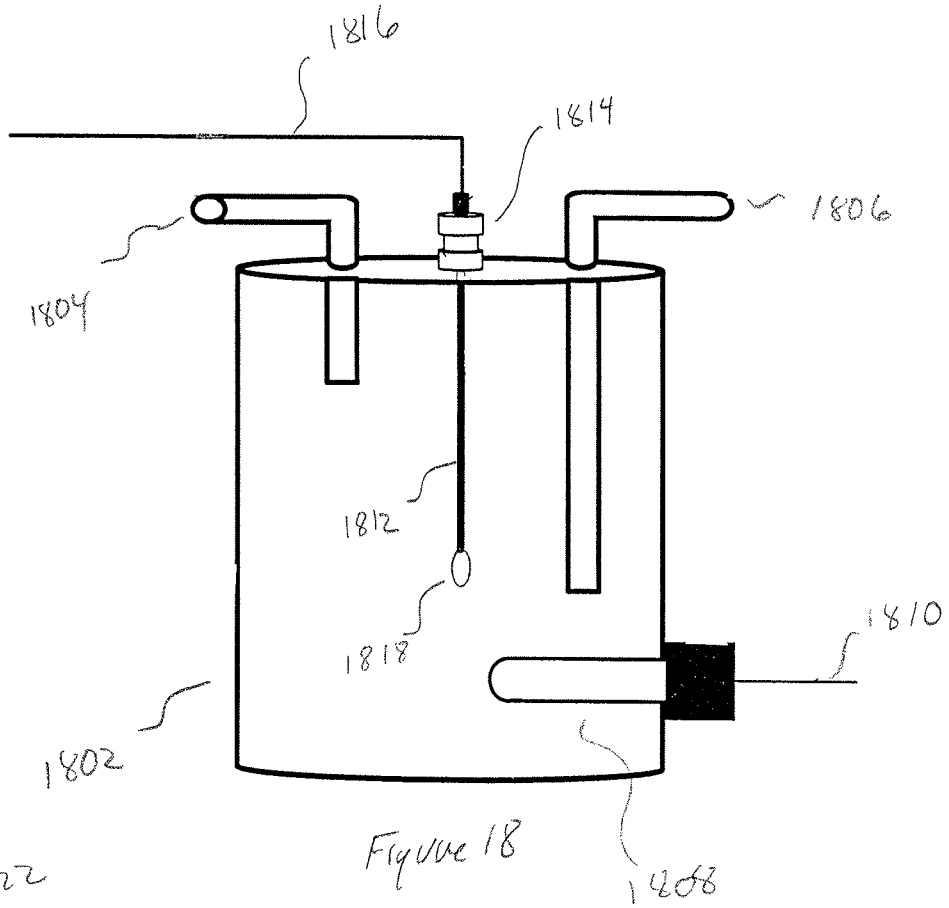
FIG. 18 illustrates water-heater and descaler modifications that provide efficient descaling and electrolysis inhibition to water heaters and other types of water-heating appliances.

FIG. 18 illustrates water-heater and descaler modifications that provide efficient descaling and electrolysis inhibition to water heaters and other types of water-heating appliances. FIG. 18 shows a water heater 1802 with a cold-water input 1804, a hot-water output 1806, and a heating element 1808 powered from an AC-power-supply input 1810. Steel water heaters often include a sacrificial metal rod or anode made of zinc, aluminium, or zinc aluminium alloy, shown installed in port 1814 in FIG. 18. This sacrificial rod is used to prevent electrolysis and corrosion of the steel tank of the water heater. The presently disclosed methods and water-treatment, descaling, and monitoring system replace the sacrificial rod with a titanium rod 1812 that is installed in port 1814.

The titanium rod 1812 is electrically insulated from steel tank 1802. The titanium rod 1812 is electrically connected to a protection signal 1816 generated by a modified descaler, discussed below. In addition, an optional UV-radiation source 1818 is connected by wires through a hollow titanium rod to generate UV light within the water tank to kill biological organisms. The titanium rod 1812 is coated with a mixed metal oxide comprising iridium oxide and tantalum oxide, which extends the useful life of the titanium rod for up to 20 years. An initial portion of the rod, the first 4 inches of the rod in one implementation, located in and below port 1814, is electrically insulated so that the protection signal must travel at least 4" to the grounded steel tank to avoid possible water electrolysis. The internal titanium rod provides effective descaling of the heating element 1808 within the water tank. The descaling signal also travels out both the cold and hot supply lines 1804 and 1806 to descale the rest of the plumbing system. Limescale coats heating elements, degrading hot water heater performance and increasing energy costs. Limescale may also coat traditional sacrificial zinc/aluminum rods, preventing them from providing electrolysis and corrosion protection of the steel tank. The presently disclosed system solves these problems by descaling the heating element 1808 and rod 1812 and also by providing electrolysis protection for steel tank 1802.

Figure 19:
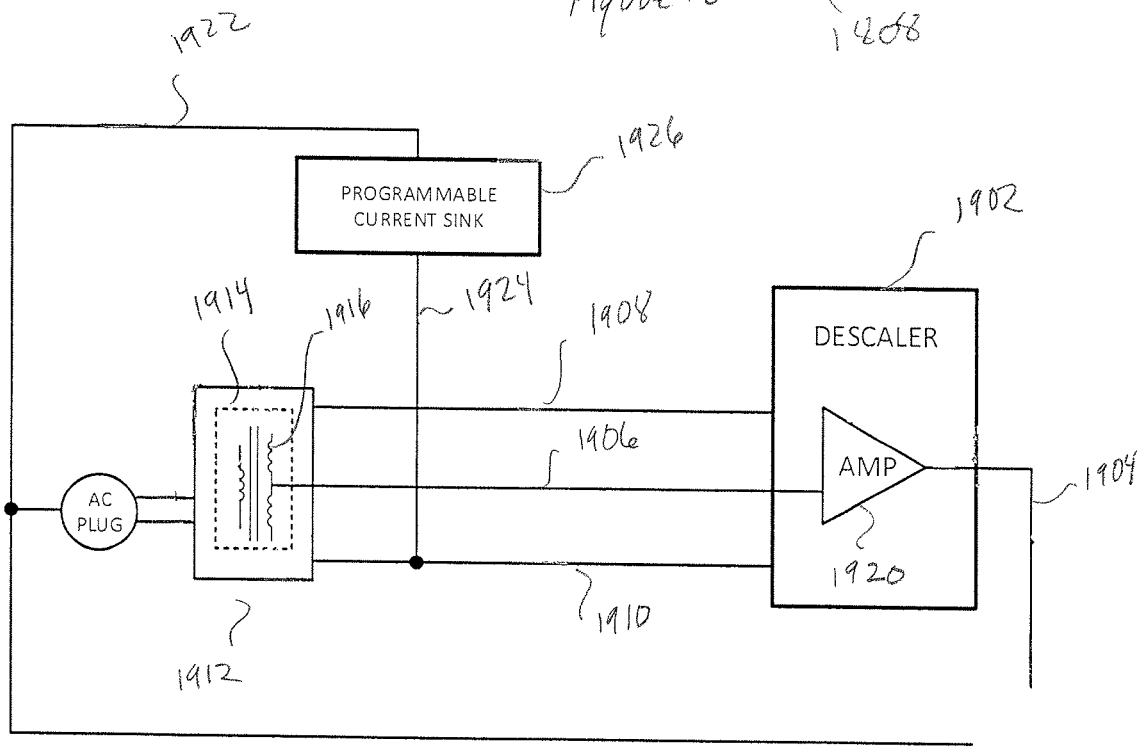
FIG. 19 illustrates the modified descaler that provides the protection signal (1816 in FIG. 18) to the modified water heater shown in FIG. 18.

FIG. 19 illustrates the modified descaler that provides the descaler and electrolysis protection signal (1816 in FIG. 18) to the water heater shown in FIG. 18. The descaler 1902 is similar to the descaler module (420 in FIG. 5), except that the output descaling signal 1904 is not passed through a capacitor, to allow for DC coupling to the titanium rod. The power supply 1912 is transformer-coupled and has a floating common 1906 and a positive 1908 and negative 1910 supply that are fixed relative to floating common 1906. The output protection signal 1904 includes a sine-wave-like 142.7 kHz descaling signal and a low DC current for inhibition of electrolysis, in the range of 1 to 100 mA, in one implementation. The power supply 1912 is a floating power supply with a transformer 1914. A center tap 1916 of the transformer is connected to common 1906. The output signal 1904 is connected to common via power amp 1920 (506 in FIG. 5). All power supplies and output 1904 have no connection to AC safety ground 1922 and are thus free to move up and down in voltage relative to AC safety ground while maintaining constant relative voltages to common and to one another.

Water heaters are required, by building codes, to be grounded to AC safety ground. The DC electrolysis-inhibition current included in the protection signal is generated in response to the small, e.g. 1 to 100 mA, DC current generated in signal line 1924 by a programmable current sink 1926. The small current pulls up the negative power line 1910, raising the voltage of the protection signal 1904, resulting in a DC electrolysis-inhibition current added to the protection signal and flowing towards the grounded water within the water heater.

Figure 20:
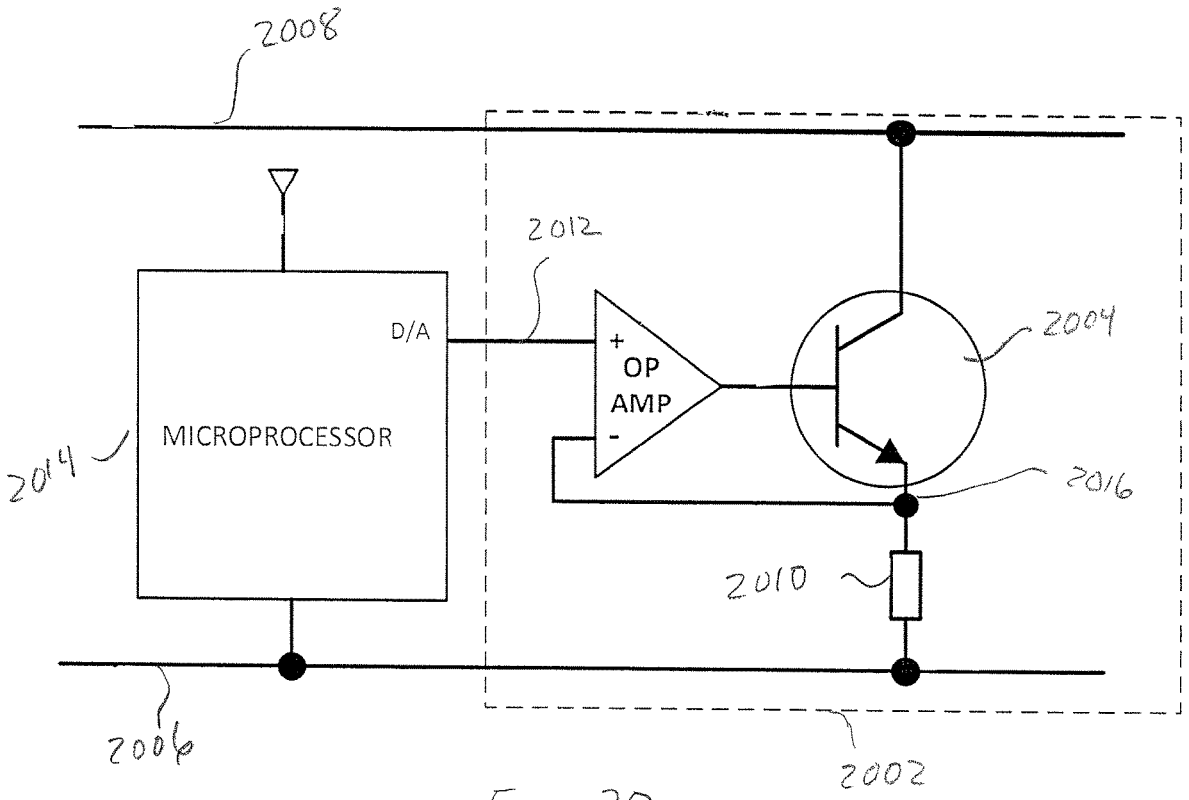
FIG. 20 illustrates the programmable current sink.

FIG. 20 illustrates the programmable current sink. The programmable current sink 2002 (1926 in FIG. 19) includes a transistor 2004 which passes current from the negative power line 2006 (1910 in FIG. 19) to AC safety ground 2008 through resistor 2010 when the voltage on a D/A output 2012 from the microprocessor 2014 (404 in FIG. 4) differs from the voltage at point 2016. Thus, the microprocessor can output a desired voltage 2012 for the DC current added to the descaling signal in the protection signal (1904 in FIG. 19) output from the descaler or descaler module by setting a corresponding voltage on the D/A output. In certain implementations, a separate descaler is used to produce the protection signal input to the water heater, while, in other implementations, the modified descaler is incorporated into the control unit of the presently disclosed water-treatment, descaling, and monitoring system.

Although the present invention has been described in terms of particular embodiments, it is not intended that the invention be limited to these embodiments. Modifications within the spirit of the invention will be apparent to those skilled in the art. For example, different implementations of the presently disclosed water-treatment, descaling, and monitoring system may employ different sets of sensors and probes, and different sets of various other remaining components in order to provide specific sets of functionalities. The various different circuit implementations, discussed above, have alternative implementations. Monitoring routines executed by the one or more microprocessors may include many different types of sophisticated monitoring and problem-detection logic. For example, sensor and probe data may be accumulated and averaged over time windows in order to provide stable readings. As mentioned above, the descaler may be used separately for targeted descaling of particular appliances.

It is appreciated that the previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

The invention claimed is:

1. A descaler comprising:

a display that outputs status information;

a processor that outputs status information to the display, outputs a time-varying voltage signal, and receives a descaling-signal-strength signal;

a descaler module comprising a descaling-signal-generation component that receives the time-varying voltage signal and outputs a sine-wave-like first descaling signal, the descaling-signal-generation component comprising a multi-pole filter which receives the time-varying voltage signal, the voltage of which oscillates between a low-voltage value and a high-voltage value, a power amplifier that receives a sine-wave-like signal output by the multi-pole filter and that outputs the first descaling signal, and a feedback signal, collected from a second descaling signal near a coupler that couples the second descaling signal to one or more of a plumbing system and a water-containing appliance, that is input to a stage of the multi-pole filter; and a descaling-signal-monitor component that outputs the descaling-signal-strength signal, the descaling-signal-monitor component comprising a series resistor that receives the first descaling signal output by the power amplifier and that outputs the second descaling signal to the coupler, a first peak-detection circuit that receives the first descaling signal input to the series resistor and that outputs a first peak-detection-circuit signal proportional to a first-descaling-signal peak voltage, and a second peak-detection circuit that receives the second descaling signal output from the series resistor and outputs a second peak-detection-circuit signal proportional to a second-descaling-signal peak voltage;

wherein the processor receives the first peak-detection-circuit signal and the second peak-detection-circuit signal, and includes a peak-detector-circuit-output-signal comparison monitor, executed by the processor, that compares the first peak-detection-circuit signal and the second peak-detection-circuit signal to detect failures in effective transfer of the second descaling signal to water within the plumbing system and/or the water-containing appliance to which the second descaling signal is coupled.

2. The descaler of claim 1 wherein, when the peak-detector-circuit-output-signal comparison monitor detects a failure to effectively transfer the second descaling signal to water within the pipe or the water-containing appliance to which the second descaling signal is coupled, the peak-detector-circuit-output-signal comparison monitor raises an alarm which is sent to the display, sent to a relay, and/or communicated via a communications interface to one or more external processor-controlled devices, including computers and smart phones.

* * * * *